US011252517B2

(12) United States Patent
Cantu

(10) Patent No.: US 11,252,517 B2
(45) Date of Patent: Feb. 15, 2022

(54) ASSISTIVE LISTENING DEVICE AND HUMAN-COMPUTER INTERFACE USING SHORT-TIME TARGET CANCELLATION FOR IMPROVED SPEECH INTELLIGIBILITY

(71) Applicant: Marcos Antonio Cantu, Rancho Viejo, TX (US)

(72) Inventor: Marcos Antonio Cantu, Oldenburg (DE)

( * ) Notice: Subject to any disclaimer, the term of this patent is extended or adjusted under 35 U.S.C. 154(b) by 0 days.

(21) Appl. No.: 16/948,902

(22) Filed: Oct. 5, 2020

(65) Prior Publication Data

US 2021/0029473 A1 Jan. 28, 2021

Related U.S. Application Data

(63) Continuation-in-part of application No. 16/514,669, filed on Jul. 17, 2019, now Pat. No. 10,796,692, (Continued)

(51) Int. Cl.
*H04R 25/00* (2006.01)
*G10L 21/0208* (2013.01)
(Continued)

(52) U.S. Cl.
CPC ..... *H04R 25/48* (2013.01); *G10K 11/17823* (2018.01); *G10K 11/17857* (2018.01);
(Continued)

(58) Field of Classification Search
CPC ..... G10L 15/20; G10L 15/02; G10L 21/02; G10L 15/08; G10L 15/22; G10L 15/265;
(Continued)

(56) References Cited

U.S. PATENT DOCUMENTS 6,983,055 B2 1/2006 Luo
8,521,518 B2 8/2013 Jung et al.
(Continued)

OTHER PUBLICATIONS

International Search Report, International Application No. PCT/US2019/042046, dated Nov. 14, 2019, 2 pages.
(Continued)

*Primary Examiner* — Yogeshkumar Patel
(74) *Attorney, Agent, or Firm* — Patterson Thuente Pedersen, P.A.

(57) ABSTRACT

An assistive listening device includes a set of microphones including an array arranged into pairs about a nominal listening axis with respective distinct intra-pair microphone spacings, and a pair of ear-worn loudspeakers. Audio circuitry performs arrayed-microphone short-time target cancellation processing including (1) applying short-time frequency transforms to convert time-domain audio input signals into frequency-domain signals for every short-time analysis frame, (2) calculating ratio masks from the frequency-domain signals of respective microphone pairs, wherein the calculation of a ratio mask includes both a frequency domain subtraction of signal values of a microphone pair and a scaling of a resulting frequency domain noise estimate by a pre-computed phase difference normalization vector, (3) calculating a global ratio mask from the plurality of ratio masks, and (4) applying the global ratio mask, and inverse short-time frequency transforms, to selected ones of the frequency-domain signals, thereby generating audio output signals for driving the loudspeakers. The circuitry and processing may also be realized in a machine hearing device executing a human-computer interface application.

20 Claims, 20 Drawing Sheets

Related U.S. Application Data which is a continuation of application No. PCT/US2019/042046, filed on Jul. 16, 2019.

(60) Provisional application No. 62/699,176, filed on Jul. 17, 2018.

(51) Int. Cl.

| | |
|---|---|
| ***G10K 11/178*** | (2006.01) |
| ***H04R 1/40*** | (2006.01) |
| ***H04S 7/00*** | (2006.01) |
| ***H04R 5/027*** | (2006.01) |
| ***H04R 3/00*** | (2006.01) |
| ***G10L 21/0216*** | (2013.01) |

(52) U.S. Cl.

CPC .. *G10K 11/17873* (2018.01); *G10K 11/17885* (2018.01); *G10L 21/0208* (2013.01); *H04R 1/406* (2013.01); *H04R 3/005* (2013.01); *H04R 5/027* (2013.01); *H04R 25/405* (2013.01); *H04R 25/407* (2013.01); *H04S 7/30* (2013.01); *G10K 2210/1081* (2013.01); *G10K 2210/111* (2013.01); *G10L 2021/02166* (2013.01)

(58) Field of Classification Search

CPC ..... G10L 15/28; G10L 2015/0631; G10L 2021/02087; H04R 3/005; H04R 1/406; H04R 2499/11; H04R 2201/401; H04R 5/027; H04R 1/04; G10K 11/175; G10K 11/17881; G10K 11/17823; G10K 2210/3027; H04S 7/30; H04S 2400/15

See application file for complete search history.

(56) References Cited

U.S. PATENT DOCUMENTS

| | | | | |
|---|---|---|---|---|
| 2008/0181422 | A1* | 7/2008 | Christoph | G10K 11/17885 381/73.1 |
| 2008/0215651 | A1* | 9/2008 | Sawada | G10L 21/0272 708/205 |
| 2015/0112672 | A1* | 4/2015 | Giacobello | G10L 21/0208 704/233 |
| 2016/0111108 | A1 | 4/2016 | Erdogan et al. | |
| 2019/0139563 | A1* | 5/2019 | Chen | G06N 3/0445 |
| 2020/0027451 | A1 | 1/2020 | Cantu | |

OTHER PUBLICATIONS

Written Opinion, International Application No. PCT/US2019/042046, dated Nov. 14, 2019, 6 pages.

Wang, Z-Q., and Wang, D., "Robust Speech Recognition from Ratio Masks." 2016 IEEE International Conference on Acoustics, Speech and Signal Processing (ICASSP) May 19, 2016 (May 19, 2016) entire document [online] URL: https://ieeexplore.ieee.org/abstract/document/7472773, retrieved on Sep. 27, 2021.

Williamson, D.S., and Wang, D., "Speech Dereverberation and Denoising using Complex Ratio Masks." 2017 IEEE International Conference on Acoustics, Speech and Signal Processing (ICASSP) Jun. 19, 2017 (Jun. 19, 2017), entire document [online] URL: https://ieeexplore.ieee.org/abstract/document/7953226, retrieved on Sep. 27, 2021.

* cited by examiner

ASSISTIVE LISTENING DEVICE AND HUMAN-COMPUTER INTERFACE USING SHORT-TIME TARGET CANCELLATION FOR IMPROVED SPEECH INTELLIGIBILITY

RELATED APPLICATION

This application is a Continuation-in-Part (CIP) of U.S. application Ser. No. 16/514,669, filed on Jul. 17, 2019, which is a continuation of PCT Application No. PCT/US2019/0420046, filed Jul. 16, 2019, which claims the benefit of U.S. Provisional Patent Application No. 62/699,176, filed on Jul. 17, 2018, each of which is incorporated herein by reference in its entirety.

STATEMENT OF U.S. GOVERNMENT RIGHTS

The invention was made with U.S. Government support under National Institutes of Health (NIH) grant no. DC000100. The U.S. Government has certain rights in the invention.

TECHNICAL FIELD

The invention described herein relates to systems employing audio signal processing to improve speech intelligibility, including for example assistive listening devices (hearing aids) and computerized speech recognition applications (human-computer interfaces).

BACKGROUND

Several circumstances and situations exist where it is challenging to hear voices and conversations of other people. As one example, while in crowded areas or large crowds, it can often be challenging for most individuals to carry on a conversation with select people. The background noise can be somewhat extreme making it virtually impossible to hear comments/conversation of individual people. In another situation, those with hearing ailments can struggle with hearing in general, especially when trying to separate the comments/conversation of one individual from others in the area. This can even be a problem while in relatively small groups. In these situation, hearing assistance devices provide an invaluable resource.

Speech recognition is also a continual challenge for automated systems. Although great strides have been made, allowing automated voice recognition to be implemented in several devices and/or systems, further advances are possible. Generally, these automated systems still have difficulty identifying a specific voice, when other conversations are happening. This situation often occurs where an automated system is being used in open areas (e.g. office complexes, coffee shops, etc.).

The "cocktail party problem" presents a challenge for both established and experimental approaches from different fields of inquiry. There is the problem itself, isolating a target talker in a mixture of talkers, but there is also the question of whether a solution can be arrived at in real time, without context-dependent training beforehand, and without a priori knowledge of the number, and locations, of the competing talkers. This has proved to be an especially challenging problem given the extremely short time-scale in which a solution must be arrived at. In order to be usable in an assistive listening device (i.e., hearing aid), any processing would have to solve this sound source segregation problem within only a few milliseconds (ms), and must arrive at a new solution somewhere in the range of every 5 to 20 ms, given that the spectrotemporal content of the challenging listening environment changes rapidly over time.

The hard problem here is not the static noise sources (think of the constant hum of a refrigerator); the real challenge is competing talkers, as speech has spectrotemporal variations that established approaches have difficulty suppressing. Stationary noise has a spectrum that does not change over time, whereas interfering speech, with its spectrotemporal fluctuations, is an example of non-stationary noise.

There are various established methods that are effective for suppressing stationary noise. However, these established methods do not provide an intelligibility benefit in non-stationary noise (i.e., interfering talkers). What is needed to solve this problem is a time-varying filter capable of computing a new set of frequency channel filter weights every few milliseconds, so as to suppress the rapid spectrotemporal fluctuations of non-stationary noise (i.e., interfering talkers). Various attempts to address these problems have been made, however many are not able to operate efficiently, or in real-time. Consequently, the challenge of suppressing non-stationary noise from interfering sound sources still exists.

SUMMARY

What is needed to solve the above mentioned problem is a time-varying filter capable of computing a new set of frequency channel weights every few milliseconds, so as to suppress the rapid spectrotemporal fluctuations of non-stationary noise. The devices described herein compute a time-varying filter, with causal and memoryless "frame by frame" short-time processing that is designed to run in real time, without any a priori knowledge of the interfering sound sources, and without any training. The devices described herein enhance speech intelligibility in the presence of both stationary and non-stationary noise (i.e., interfering talkers).

The devices described herein leverage the computational efficiency of the Fast Fourier Transform (FFT). Hence, they are physically and practically realizable as devices that can operate in real-time, with reasonable and usable battery life, and without reliance on signifcant computational resources. The processing is designed to use short-time analysis windows in the range of 5 to 20 ms; for every analysis frame, frequency-domain signals are computed from time-domain signals, a vector of frequency channel weights are computed and applied in the frequency domain, and the filtered frequency domain signals are converted back into time domain signals.

In one variation, an Assistive Listening Device (ALD) employs an array (e.g., 6) of forward-facing microphones whose outputs are processed by Short-Time Target Cancellation (STTC) to compute a Time-Frequency (T-F) mask (i.e., time-varying filter) used to attenuate non-target sound sources in Left and Right near-ear microphones. The device can enhance speech intelligibility for a target talker from a designated look direction while preserving binaural cues that are important for spatial hearing.

In another application, STTC processing is implemented as a computer-integrated front-end for machine hearing applications such as Automatic Speech Recognition (ASR) and teleconferencing. More generally, the STTC front-end approach may be used for Human-Computer Interaction (HCI) in environments with multiple competing talkers, such as restaurants, customer service centers, and air-traffic control towers. Variations could be integrated into use-environment structures such as the dashboard of a car or the cockpit of an airplane.

More particularly, in one aspect an assistive listening device is disclosed that includes a set of microphones generating respective audio input signals and including an array of the microphones being arranged into pairs about a nominal listening axis with respective distinct intra-pair microphone spacings, and a pair of ear-worn loudspeakers. Audio circuitry is configured and operative to perform arrayed-microphone short-time target cancellation processing including (1) applying short-time frequency transforms to convert the audio input signals into respective frequency-domain signals for every short-time analysis frame, (2) calculating respective pair-wise ratio masks and binary masks from the frequency-domain signals of respective microphone pairs of the array, wherein the calculation of a ratio mask includes a frequency domain subtraction of signal values of a microphone pair, (3) calculating a global ratio mask from the pair-wise ratio masks and a global binary mask from the pair-wise binary masks, (4) calculating a thresholded ratio mask, an effective time-varying filter with a vector of frequency channel weights for every short-time analysis frame, from the global ratio mask and global binary mask, and (5) applying the thresholded ratio mask, and inverse short-time frequency transforms to selected ones of the frequency-domain signals to generate audio output signals for driving the loudspeakers. Although the preferred processing involves using the thresholded ratio mask to produce the output, an effective assistive listening device that enhances speech intelligibility could be built using only the global ratio mask.

In another aspect, a machine hearing device is disclosed that includes processing circuitry configured and operative to execute a machine hearing application to identify semantic content of a speech signal supplied thereto and to perform an automated action in response to the identified semantic content, and a set of microphones generating respective audio input signals and including an array of the microphones arranged into pairs about a nominal listening axis with respective distinct intra-pair microphone spacings. Audio circuitry is configured and operative to perform arrayed-microphone short-time target cancellation processing including (1) applying short-time frequency transforms to convert the audio input signals into respective frequency-domain signals for every short-time analysis frame, (2) calculating respective pair-wise ratio masks and binary masks from the frequency-domain signals of respective microphone pairs of the array, wherein the calculation of a ratio mask includes a frequency domain subtraction of signal values of a microphone pair, (3) calculating a global ratio mask from the pair-wise ratio masks and a global binary mask from the pair-wise binary masks, (4) calculating a thresholded ratio mask, an effective time-varying filter with a vector of frequency channel weights for every short-time analysis frame, from the global ratio mask and global binary mask, and (5) applying the thresholded ratio mask and inverse short-time frequency transforms to selected ones of the frequency-domain signals to generate audio output signals for driving the loudspeakers. Although the preferred processing involves using the thresholded ratio mask to produce the output, an effective machine hearing device could be built using only the global ratio mask.

There are existing methods, including adaptive beamformers such as the Multichannel Wiener Filter (MWF) and Minimum Variance Distortionless Response (MVDR) beamformers, that use past values (i.e., memory) to compute a filter that can attenuate stationary sound sources; these methods are appropriate for attenuating the buzz of a refrigerator or the hum of an engine, which are stationary sound sources that do not have unpredictable spectrotemporal fluctations. The approach described herein uses Short-Time Target Cancellation (STTC) processing to compute a time-varying filter using only the data from short-time analysis windows; it computes a time-varying filter, in the form of a vector of frequency channel weights for every analysis frame, using only the data from the current analysis frame. As such, it is causal, memoryless, is capable of running in real time, and can be used to attenuate both stationary and non-stationary sound sources.

The approach and devices described herein can attenuate interfering talkers (i.e., non-stationary sound sources) using real-time processing. Another advantage of the approach described herein, relative to adaptive beamformers such as the MWF and MVDR, is that the time-varying filter computed by the STTC processing is a set of frequency channel weights that can be applied independently to signals at the Left and Right ear, thereby enhancing speech intelligibility for a target talker while still preserving binaural cues for spatial hearing.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views.

DESCRIPTION OF EMBODIMENTS

Figure 1:
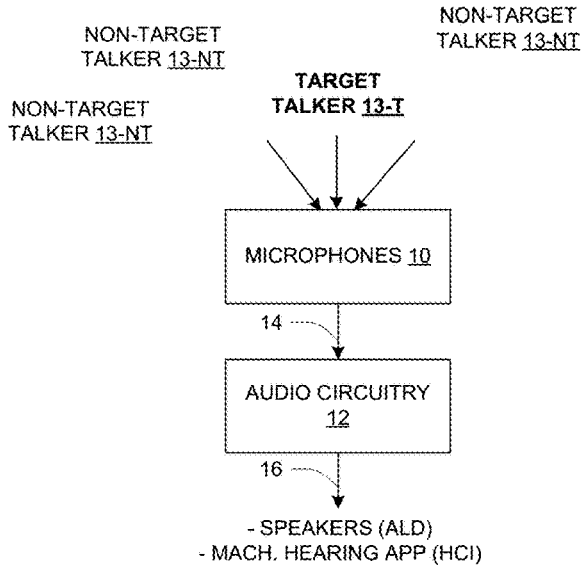
FIG. 1 is a general block diagram of a system employing STTC processing for improving speech intelligibility for a target talker.

FIG. 1 shows an audio system in generalized form, including microphones [10] having outputs coupled to audio circuitry [12]. In operation, the microphones [10] respond to acoustic input of an immediate environment that includes a target talker [13-T] and one or more nontarget talkers [13-NT], generating respective audio signals [14]. These are supplied to the audio circuitry [12], which applies short-time target cancellation (STTC) processing to enhance the intelligibility of the target talker [13-T] in the presence of the interfering non-target talkers [13-NT]. Details of the STTC processing are provided herein.

The general arrangement of FIG. 1 may be realized in a variety of more specific ways, two of which are described in some detail. In one realization, the arrangement is incorporated into an assistive listening device (ALD) or "hearing aid", and in this realization the outputs [16] from the audio circuitry [12] are supplied to in-ear or near-ear loudspeakers (not shown in FIG. 1). In another realization, the arrangement is used as initial or "front end" processing of a human-computer interface (HCI), and the outputs [16] convey noise-reduced speech input to a machine hearing application (not shown in FIG. 1). Again, multiple realizations are possible.

Figure 2:
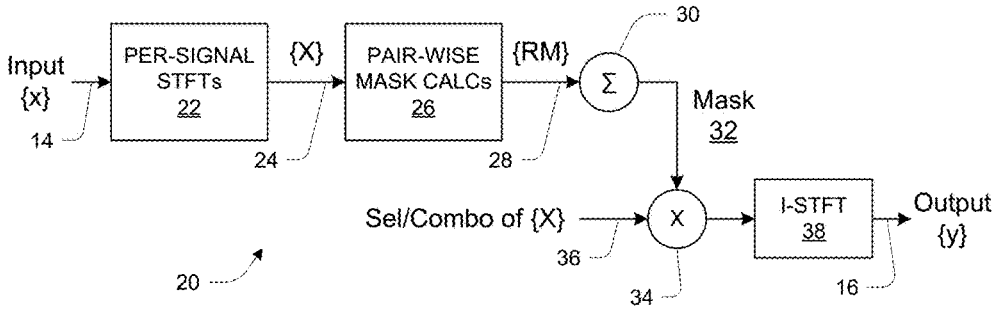
FIG. 2 is a general block diagram of STTC processing.

FIG. 2 is a generalized description of the STTC processing [20] carried out by the exemplary audio circuitry [12]. This processing [20] includes a set of short-time Fourier transforms (STFTs) [22], each applied to a corresponding input signal [14] from a corresponding microphone [10], and each generating a corresponding frequency-domain signal [24]. The set of input signals [14] and the set of frequency-domain signals [24] are shown as x and X respectively. The STTC processing [20] further includes a set of pair-wise mask calculations [26], each operating upon a corresponding pair of the frequency-domain signals [24] and generating a corresponding ratio mask (RM) [28] (the set of all ratio masks shown as RM). A combiner [30] combines the ratio masks [28] into an overall mask [32], which is provided to a scaler [34] along with a selection or combination (Sel/Combo) [36] of the frequency-domain signals {X}. The output of the scaler [34] is a noise-reduced frequency-domain signal supplied to an inverse-STFT (I-STFT) [38] to generate the output signal(s) [16], shown as y.

Briefly, the selection/combination [36] may or may not include frequency domain signals X that are also used in the pair-wise mask calculations [26]. In an ALD implementation as described more below, it may be beneficial to apply the mask-controlled scaling [34] to signals from near-ear microphones that are separate from the microphones whose outputs are used in the pair-wise mask calculations [26]. Use of such separate near-ear microphones can help maintain important binaural cues for a user. In a computer-based implementation also described below, the mask-controlled scaling [34] may be applied to a sum of the outputs of the same microphones whose signals are used to calculate the masks.

I. System Description of 6-Microphone Short-Time Target Cancellation (STTC) Assistive Listening Device (ALD).

Figure 3:
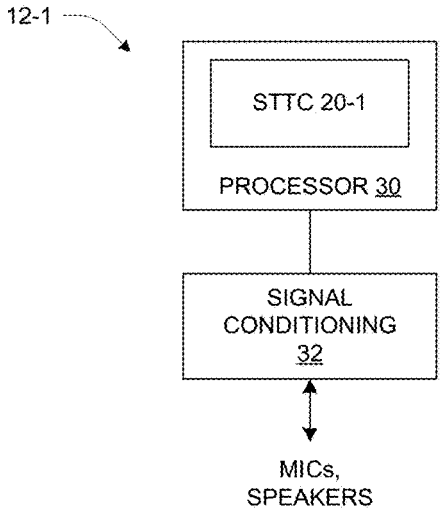
FIG. 3 is a block diagram of audio circuitry of an assistive listening device (ALD)

FIGS. 3-8 show an embodiment of an assistive listening device (ALD) using 6-microphone STTC. As will be recognized, this provides one version of an effective ALD, however many variations are possible. FIG. 3 is a block diagram of first audio circuitry [12-1] of the 6-microphone ALD. It includes a processor [30] performing first STTC processing [20-1], as well as signal conditioning circuitry [32]. The signal conditioning circuitry [32] interfaces the processor [30] with the separate microphones and loudspeakers (not shown), and generally includes signal converters (digital to analog, analog to digital), amplifiers, analog filters, etc. as needed. In some embodiments, some or all of the conditioning circuitry [32] may be included with the processor [30] in a single integrated or hybrid circuit, and such a specialized circuit may be referred to as a digital signal processor or DSP.

Figure 4:
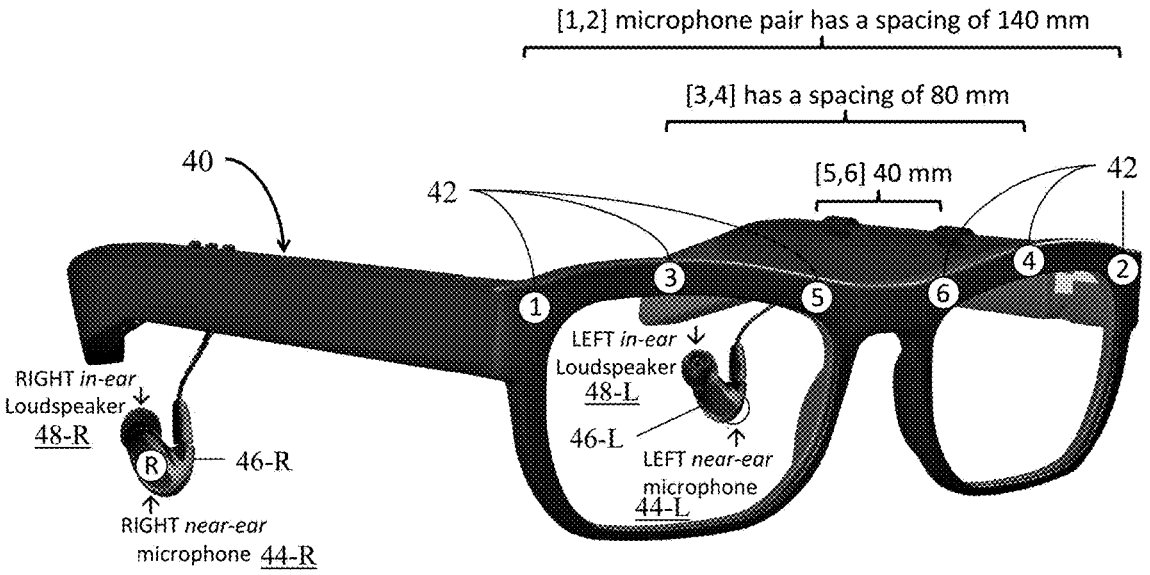
FIG. 4 is a depiction of a specialized eyeglass frame incorporating components of an ALD.

FIG. 4 shows an example physical realization of an assistive listening device or ALD, specifically as a set of microphones and loudspeakers incorporated in an eyeglass frame [40] worn by a user. In this realization, the microphones [10] are realized using six forward-facing microphones [42] and two near-ear microphones [44-R], [44-L]. The forward-facing microphones [42] are enumerated 1-6 as shown, and functionally arranged into pairs 1-2, 3-4 and 5-6, with respective distinct intra-pair spacings of 140 mm, 80 mm and 40 mm respectively in one embodiment. The near-ear microphones [44] are included in respective right and left earbuds [46-R], [46-L] along with corresponding in-ear loudspeakers [48-R], [48-L].

Generally, the inputs from the six forward-facing microphones [42] are used to compute a Time-Frequency (T-F) mask (i.e. time-varying filter), which is used to attenuate non-target sound sources in the Left and Right near-ear microphones [44-L], [44-R]. The device boosts speech intelligibility for a target talker [13-T] from a designated look direction while preserving binaural cues that are important for spatial hearing.

The approach described herein avoids Interaural level Difference (ILD) compensation by integrating the microphone pairs [42] into the frame [40] of a pair of eyeglasses and giving them a forward facing half-omni directionality pattern; with this microphone placement, there is effectively no ILD and thus no ILD processing is required. One downside to this arrangement, if one were to use only these forward facing microphones, is the potential loss of access to both head shadow ILD cues and the spectral cues provided by the pinnae (external part of ears). However, such cues can be provided to the user by including near-ear microphones [44]. The forward-facing microphone pairs [42] are used to calculate a vector of frequency channel weights for each short-time analysis frame (i.e., a time-frequency mask); this vector of frequency channel weights is then used to filter the output of the near-ear microphones [44]. Notably, the frequency channel weights for each time slice may be applied independently to both the left and right near-ear microphones [44-L], [44-R], thereby preserving Interaural Time Difference (ITD) cues, spectral cues, and the aforementioned ILD cues. Hence, the assistive listening device described herein can enhance speech intelligibility for a target talker, while still preserving the user's natural binaural cues, which are important for spatial hearing and spatial awareness.

It is noted that the ALD as described herein may be used in connection with separate Visually Guided Hearing Aid (VGHA) technology, in which a VGHA eyetracker can be used to specify a steerable "look" direction. Steering may be accomplished using shifts, implemented in either the time domain or frequency domain, of the Left and Right signals. The STTC processing [20-1] boosts intelligibility for a target talker [13-T] in the designated "look" direction and suppresses the intelligibility of non-target talkers (or distractors) [13-NT], all while preserving binaural cues for spatial hearing.

STTC processing consists of a computationally efficient implementation of the target cancellation approach to sound source segregation, which involves removing target talker sound energy and computing gain functions for T-F tiles according to the degree to which each T-F tile is dominated by energy from the target or interfering sound sources. The STTC processing uses subtraction in the frequency domain to implement target cancellation, using only the Short-Time Fourier Transforms (STFTs) of signals from microphones.

The STTC processing computes an estimate of the Ideal Ratio Mask (IRM), which has a transfer function equivalent to that of a time-varying Wiener filter; the IRM uses the ratio of signal (i.e., target speech) energy to mixture energy within each T-F unit:

$$IRM(t, f) = \frac{S^2(t, f)}{S^2(t, f) + N^2(t, f)} \tag{1}$$

where $S^2(t, f)$ and $N^2(t, f)$, are the signal (i.e., target speech) energy and noise energy, respectively. The mixture energy is the sum of the signal energy and noise energy.

The time-domain mixture $x_i$ [m] of sound at the ith microphone is composed of both signal ($s_i$) and noise ($\eta_i$) components:

$$x_i[m]=s_i[m]+\eta_i[m] \tag{2}$$

Effecting sound source segregation amounts to an "unmixing" process that removes the noise ($\eta$) from the mixture (x) and computes an estimate ($\hat{s}$) of the signal (s). Whereas the IRM is computed using "oracle knowledge" access to both the "ground truth" signal ($s_i$) and the noise ($\eta_i$) components, the STTC processing has access to only the mixture ($x_i$) at each microphone. For every pair of microphones, the STTC processing computes both a Ratio Mask (RM) and a Binary Mask (BM) using only the STFTs of the sound mixtures at each microphone. The STFT $X_i[n,k]$ of the sound mixture $x_i[m]$ at the ith microphone is as follows:

$$X_i[n, k] = STFT\{x_i[m]\} = \sum_{m=-\infty}^{\infty} x_i[m]w[nH - m]e^{-j\frac{2\pi k}{F}m} \tag{3}$$

where w[n] is a finite-duration Hamming window; n and k are discrete indices for time and frequency, respectively; H is a temporal sampling factor (i.e., the Hop size between FFTs) and F is a frequency sampling factor (i.e., the FFT length).

The logic underlying the STTC processing involves computing an estimate of the noise ($\eta$), so as to subtract it from the mixture (x) and compute an estimate ($\hat{s}$) of the signal (s). This filtering (i.e. subtraction of the noise) is effected through a T-F mask, which is computed via target cancellation in the frequency domain using only the STFTs. The STTC processing consists of Short-Time Fourier Transform Magnitude (STFTM) computations, computed in parallel, that yield Mixture ($\hat{M}$) and Noise ($\hat{N}$) estimates that can be used to approximate the IRM, and thereby compute a time-varying filter. The Mixture ($\hat{M}$), Noise ($\hat{N}$) and Signal ($\hat{S}$) estimates for each T-F tile are computed as follows using the frequency-domain signals ($X_i$) from a pair (i=[1, 2]) of microphones:

$$\hat{M}[n,k]=(|X_1[n,k]|+|X_2[n,k]|), \tag{4}$$

$$\hat{N}[n,k]=(|X_1[n,k]-X_2[n,k]|), \tag{5}$$

$$\hat{S}[n,k]=\hat{M}[n,k]-\hat{N}[n,k] \tag{6}$$

The processing described here assumes a target talker "straight ahead" at 0°. With the target-talker waveforms at the two microphones in phase (i.e., time-aligned) with each other, the cancellation process can be effected via subtraction in either the time domain (e.g., $x_1[m]-x_2[m]$) or the frequency domain, as in the Noise ($\hat{N}$) estimate shown above.

The Noise estimate ($\hat{N}$) is computed by subtracting the STFTs before taking their magnitude, thereby allowing phase interactions that cancel the target spectra. The Mixture ($\hat{M}$) estimate takes the respective STFT magnitudes before addition, thereby preventing phase interactions that would otherwise cancel the target spectra. A Signal ($\hat{S}$) estimate can be computed by subtracting the Noise ($\hat{N}$) estimate from the Mixture ($\hat{M}$) estimate. The processing described in this section assumes a target talker "straight ahead" at 0°. However, the "look" direction can be "steered" via sample shifts implemented in the time domain prior to T-F analysis. Alternatively, these "look" direction shifts could be implemented in the frequency domain.

Assuming a perfect cancellation of only the target (i.e., Signal) spectra, the $\hat{N}$ term contains the spectra of all non-target sound sources (i.e., Noise) in each T-F tile. The STTC processing uses the Mixture ($\hat{M}$) and Noise ($\hat{N}$) STFTM computations to estimate the ratio of Signal ($\hat{S}$) (i.e., target) energy to mixture energy in every T-F tile:

$$RM[n,k] = \frac{\hat{M}[n,k] - \hat{N}[n,k]}{\hat{M}[n,k]} = \frac{\hat{S}[n,k]}{\hat{S}[n,k] + \hat{N}[n,k]} \tag{7}$$

The Mixture ($\hat{M}$) and Noise ($\hat{N}$) terms are short-time spectral magnitudes used to estimate the IRM for multiple frequency channels [k] in each analysis frame [n]. The resulting Ratio Mask RM[n, k] is a vector of frequency channel weights for each analysis frame. RM[n, k] can be computed directly using the STFTs of the signals from the microphone pair:

$$RM[n,k] = \frac{|X_1[n,k]| + |X_2[n,k]| - |X_1[n,k] - X_2[n,k]|}{|X_1[n,k]| + |X_2[n,k]|} \tag{8}$$

A Binary Mask BM[n, k] may also be computed using a thresholding function, with threshold value ψ, which may be set to a fixed value of ψ=0.2 for example:

$$BM[n,k] = \begin{cases} 1 & \text{if } RM[n,k] \geq \psi \\ 0 & \text{if } RM[n,k] < \psi \end{cases} \tag{9}$$

Figure 5:
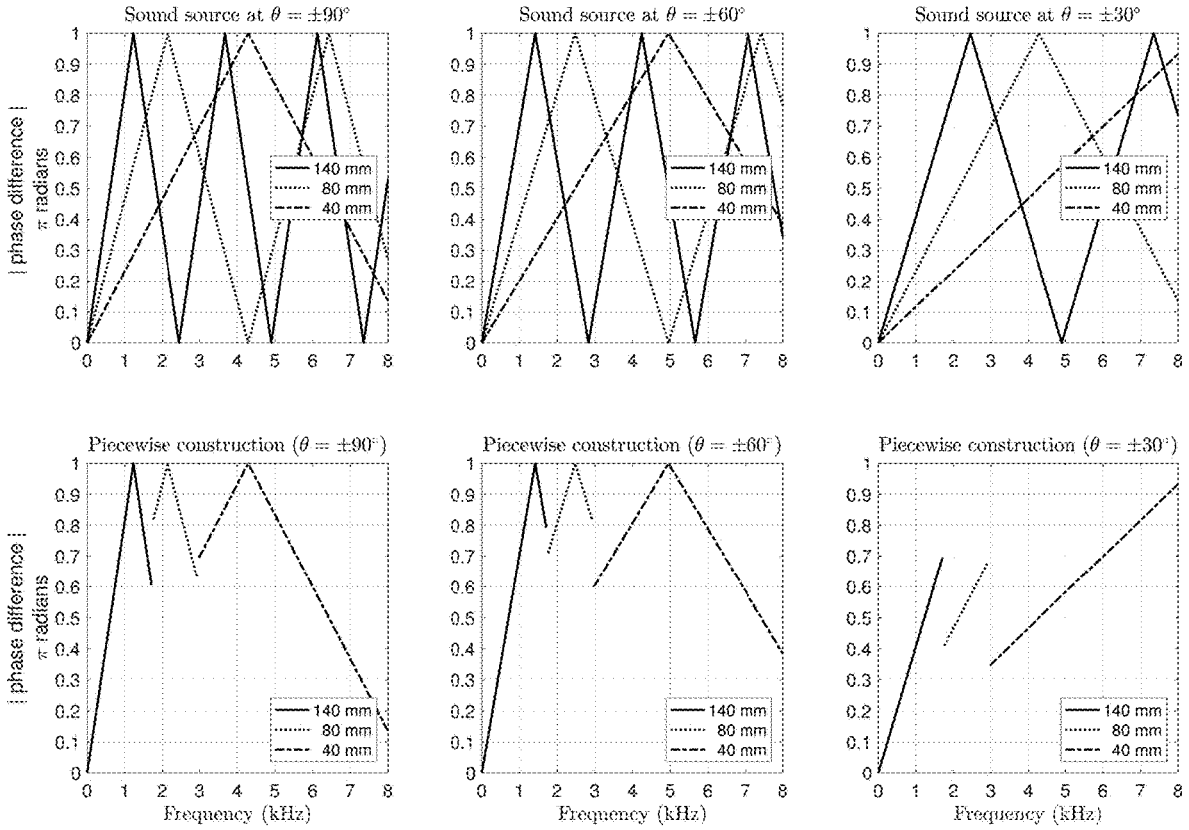
FIG. 5 is a plot of phase separations for microphone pairs of an ALD.

FIG. 5 illustrates one aspect of the disclosed technique, namely addressing the problem of "null phase differences" that impair performance within certain frequencies for any one pair of microphones. The top panel illustrates the phase separations of the three pairs of microphones across the frequency range of 0 to 8 kHz, and for three different interfering sound source directions (30°, 60° and 90°). For each microphone pair with respective intra-pair microphone spacing, there are frequencies at which there is little to no phase difference, such that target cancellation based on phase differences cannot be effectively implemented. The disclosed technique employs multiple microphone pairs, with varied spacings, to address this issue.

In the illustrated example, three microphone pairs having respective distinct spacings (e.g. 140, 80 and 40 mm) are used, and their outputs are combined via "piecewise construction", as illustrated in the bottom panel of FIG. 5; i.e., combined in a manner that provides positive absolute phase differences for the STTC processing to work with in the 0-8 kHz band that is most important for speech intelligibility. In particular, this plot illustrates the "piecewise construction" approach to creating a chimeric Global Ratio Mask $RM_G$ from the individual Ratio Masks for the three microphone pairs ([1, 2], [3, 4], [5, 6]). This is described in additional detail below.

Figure 6:
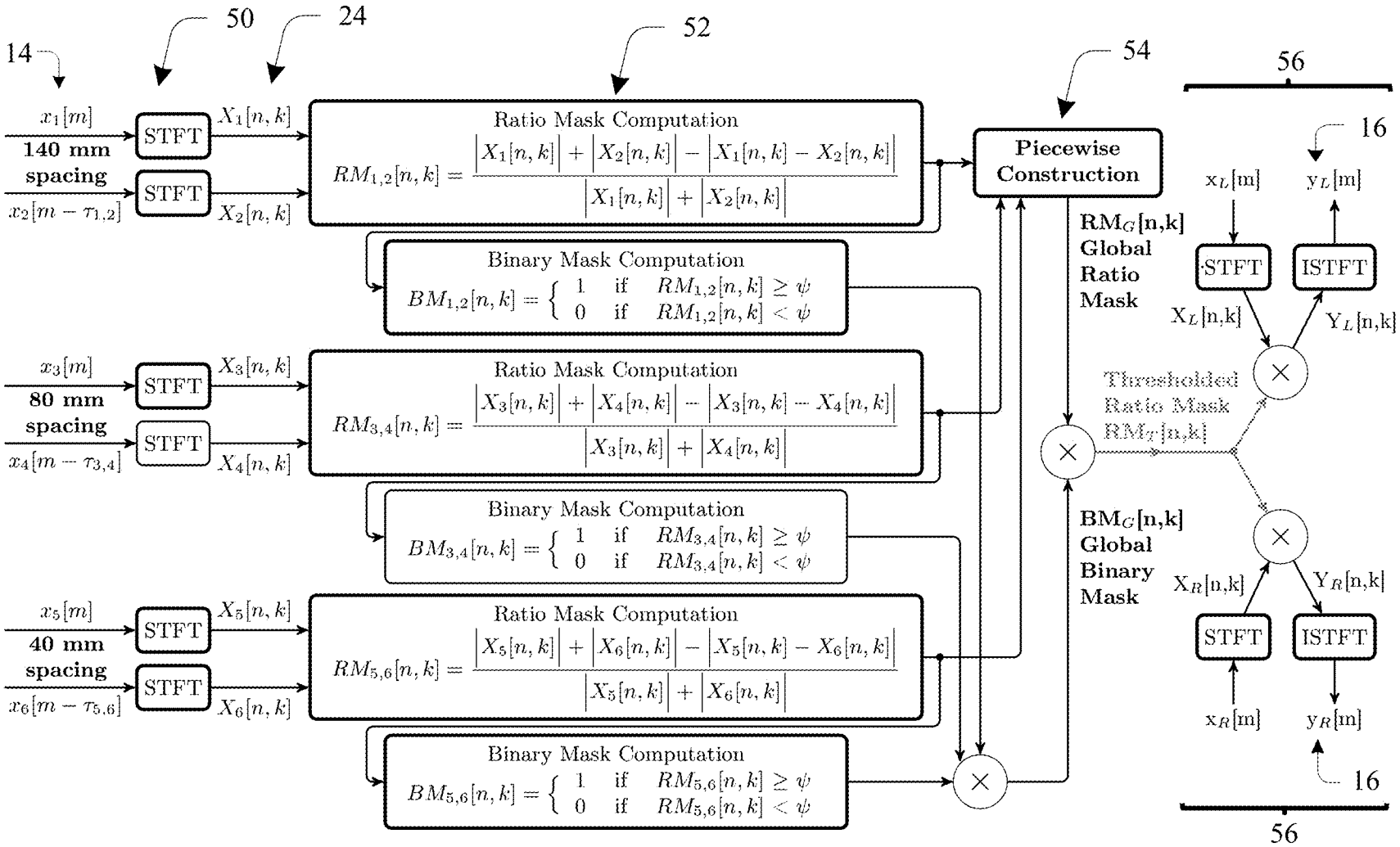
FIG. 6 is a block diagram of STTC processing for an ALD.

FIG. 6 is a block diagram of the STTC processing [20-1] (FIG. 3). Overall, it includes the following distinct stages of calculations:

1. Short-Time Fourier Transform (STFT) processing [50], converts each microphone signal into frequency domain signal
2. Ratio Mask (RM) and Binary Mask (BM) processing [52], applied to frequency domain signals of microphone pairs
3. Global Ratio Mask ($RM_G$) and Thresholded Ratio Mask ($RM_T$) processing [54], uses ratio masks of all microphone pairs
4. Output signal processing [56], uses the Thresholded Ratio Mask ($RM_T$) to scale/modify selected microphone signals to serve as output signal(s) [16]

The above stages of processing are described in further detail below.

1. STFT Processing [50]

Short-Time Fourier Transforms (STFTs) are continually calculated from frames of each input signal x[m] according to the following calculation:

$$X_i[n,k] = STFT\{x_i[m]\} = \sum_{m=-\infty}^{\infty} x_i[m]w[nH - m]e^{-j\frac{2\pi k}{F}m} \tag{10}$$

where i is the index of the microphone, w[n] is a finite-duration Hamming window; n and k are discrete indices for time and frequency, respectively; H is a temporal sampling factor (i.e., the Hop size between FFTs) and F is a frequency sampling factor (i.e., the FFT length).

2. STTC Processing [52]

Pairwise ratio masks RM, one for each microphone spacing (140, 80 and 40 mm) are calculated as follows; i.e., there is a unique RM for each pair of microphones ([1,2], [3,4], [5,6]):

$$RM_{1,2}[n,k] = \frac{|X_1[n,k]| + |X_2[n,k]| - |X_1[n,k] - X_2[n,k]|}{|X_1[n,k]| + |X_2[n,k]|} \tag{11a}$$

$$RM_{3,4}[n,k] = \frac{|X_3[n,k]| + |X_4[n,k]| - |X_3[n,k] - X_4[n,k]|}{|X_3[n,k]| + |X_4[n,k]|} \tag{11b}$$

$$RM_{5,6}[n,k] = \frac{|X_5[n,k]| + |X_6[n,k]| - |X_5[n,k] - X_6[n,k]|}{|X_5[n,k]| + |X_6[n,k]|} \tag{11c}$$

Pairwise Binary Masks BM are calculated as follows, using a thresholding function ψ, which in one example is a constant set to a relatively low value (0.2 on a scale of 0 to 1):

$$BM_{1,2}[n,k] = \begin{cases} 1 & \text{if } RM_{1,2}[n,k] \geq \psi \\ 0 & \text{if } RM_{1,2}[n,k] < \psi \end{cases} \tag{12a}$$

$$BM_{3,4}[n,k] = \begin{cases} 1 & \text{if } RM_{3,4}[n,k] \geq \psi \\ 0 & \text{if } RM_{3,4}[n,k] < \psi \end{cases} \tag{12b}$$

$$BM_{5,6}[n,k] = \begin{cases} 1 & \text{if } RM_{5,6}[n,k] \geq \psi \\ 0 & \text{if } RM_{5,6}[n,k] < \psi \end{cases} \tag{12c}$$

In the low frequency channels, a ramped binary mask threshold may be used for the most widely spaced microphone pair ($BM_{1,2}$) to address the issue of poor cancellation at these low frequencies. Thus at the lowest frequencies, where cancellation is least effective, a higher threshold is used. An example of such a ramped threshold is described below.

3. Global Ratio Mask ($RM_G$) and Thresholded Ratio Mask ($RM_T$) Processing [54]

As mentioned above, a piecewise approach to creating a chimeric Global Ratio Mask $RM_G$ from the individual Ratio Masks for the three microphone pairs ([1,2], [3,4], [5,6]) is used. In one example, the RMG is constructed, in a piecewise manner, thusly (see bottom panel of FIG. 5):

$$RM_G[n, 1{:}32] = RM_{1,2}[n, 1{:}32](\approx 0 \rightarrow 1500\text{ Hz})$$

$$RM_G[n, 33{:}61] = RM_{3,4}[n, 33{:}61](\approx 1500 \rightarrow 3000\text{ Hz})$$

$$RM_G\left[n, 62{:}\frac{F}{2}\right] = RM_{5,6}\left[n, 62{:}\frac{F}{2}\right]\left(\approx 3000 \rightarrow \frac{F_S}{2}\text{Hz}\right)$$

The illustration of piecewise selection of discrete frequency channels (k) shown above is for a sampling frequency ($F_s$) of 50 kHz and an FFT size (F) of 1024 samples; the discrete frequency channels used will vary according to the specified values of Fs and F. The piecewise-constructed Global Ratio Mask $RM_G$ is also given conjugate symmetry (i.e. negative frequencies are the mirror image of positive frequencies) to ensure that the STTC processing yields a real (rather than complex) output. Additional detail is given below.

A singular Global Binary Mask $BM_G$ is computed from the three Binary Masks ($BM_{1,2}$, $BM_{3,4}$, $BM_{5,6}$), where x specifies element-wise multiplication:

$$BM_G[n,k]=BM_{1,2}[n,k]\times BM_{3,4}[n,k]\times BM_{5,6}[n,k] \tag{13}$$

Multiplication of the Global Ratio Mask $RM_G$ with the Global Binary Mask $BM_G$ yields a Thresholded Ratio Mask $RM_T[n, k]$ that is used for reconstruction of the target signal in the output signal processing [56], as described below. Note that $RM_T[n, k]$ has weights of 0 below the threshold ψ and continuous "soft" weights at and above ψ.

The Global Ratio Mask ($RM_G$), the Global Binary Mask ($BM_G$) and the Thresholded Ratio Mask ($RM_T$) are all effective time-varying filters, with a vector of frequency channel weights for every analysis frame. Any one of the three (i.e., $RM_G$, $BM_G$ or $RM_T$) can provide an intelligibility benefit for a target talker, and supress both stationary and non-stationary interfering sound sources. $RM_T$ is seen as the most desirable, effective and useful of the three; hence it is used for producing the output in the block diagram shown in FIG. 6.

4. Output Signal Processing [56]

The output signal(s) may be either stereo or monaural ("mono"), and these are created in correspondingly different ways as explained below.

Reconstruction of Target Signal with STEREO Output

Stereo output may be used, for example in applications such as ALD where it is important to preserve binaural cues such as ILD, ITD. The output of the STTC processing is an estimate of the target speech signal from the specified look direction. The Left and Right (i.e. stereo pair) Time-Frequency domain estimate ($Y_L[n, k]$ and $Y_R[n, k]$) of the target speech signal ($y_L[m]$ and $y_R[m]$) can be described thusly, where $X_L$ and $X_R$ are the Short Time Fourier Transforms (STFTs) of the signals $x_L$ and $x_R$, from the designated Left and Right in-ear or near-ear microphones [44] (FIG. 4), and the Thresholded Ratio Mask $RM_T[n, k]$ is the conjugate-symmetric mask (i.e. the set of short-time weights for all frequencies, both positive and negative) computed in the mask processing [54] as described above:

$$Y_L[n,k]=RM_T[n,k]\times X_L[n,k]\,Y_R[n,k]=RM_T[n,k]\times X_R[n,k] \tag{14}$$

Alternatively, the Global Ratio Mask ($RM_G$) could be used to produce the stereo output:

$$Y_L[n,k]=RM_G[n,k]\times X_L[n,k]\,Y_R[n\ k]= RM_G[n,k]\times X_R[n,k] \tag{15}$$

Synthesis of a stereo output ($y_L[m]$ and $y_R[m]$) estimate of the target speech signal consists of taking the Inverse Short Time Fourier Transforms (ISTFTs) of $Y_L[n, k]$ and $Y_R[n, k]$ and using the overlap-add method of reconstruction.

While the Global Binary Mask $BM_G$ could also be used to produce the stereo output, the continuously valued frequency channel weights of the $RM_G$ and $RM_T$ are more desirable, yielding superior performance in speech intelligibility and speech quality performance than the $BM_G$. $RM_T$ is seen as the most desirable, effective and useful of the three; hence it is used for producing the output in the block diagram shown in FIG. 6. However, an effective system for enchancing speech intelligibility could be built using only $RM_G$, hence the claim section builds upon a system that uses $RM_G$ to filter the output of the assistive listening device.

Reconstruction of Target Signal with MONO Output

A mono output (denoted below with the subscript M) may be used in other applications in which the preservation of binaural cues is absent or less important. In one example, a mono output can be computed via an average of the STFTs across multiple microphones, where I is the total number of microphones:

$$X_M[n, k] = \frac{\sum_{i=1}^{I} X_i[n, k]}{I} \tag{16}$$

$$Y_M[n, k] = RM_T[n, k] \times X_M[n, k] \tag{17}$$

Alternatively, the Global Ratio Mask ($RM_G$) could be used to produce the mono output:

$$Y_M[n,k]=RM_G[n,k]\times X_M[n,k] \tag{18}$$

The Mono output $y_M[m]$ is produced by taking Inverse Short Time Fourier Transforms (ISTFT) of $Y_M[n, k]$ and using the overlap-add method of reconstruction.

Steering the Nonlin-ear Beamformer's "Look" Direction

The default target sound source "look" direction is "straight ahead" at 0°. However, if deemed necessary or useful, an eyetracker could be used to specify the "look" direction, which could be "steered" via τ time shifts, implemented in either the time or frequency domains, of the Left and Right signals. The STTC processing could boost intelligibility for the target talker from the designated "look" direction and suppress the intelligibility of the distractors, all while preserving binaural cues for spatial hearing.

The τ sample shifts are computed independently for each pair of microphones, where $F_s$ is the sampling rate, d is the inter-microphone spacing in meters, λ is the speed of sound in meters per second and θ is the specified angular "look" direction in radians:

$$\tau_{[1,2]} = \left\lfloor f_s \times \frac{d_{[1,2]}}{\lambda}\sin(\theta)\right\rfloor \tag{19a}$$

$$\tau_{[3,4]} = \left\lfloor f_s \times \frac{d_{[3,4]}}{\lambda}\sin(\theta)\right\rfloor \tag{19b}$$

$$\tau_{[5,6]} = \left\lfloor f_s \times \frac{d_{[5,6]}}{\lambda}\sin(\theta)\right\rfloor \tag{19c}$$

These τ time shifts are used both for the computation of the Ratio Masks (RMs) as well as for steering the beamformer used for the Mono version of the STTC processing.

Figure 7:
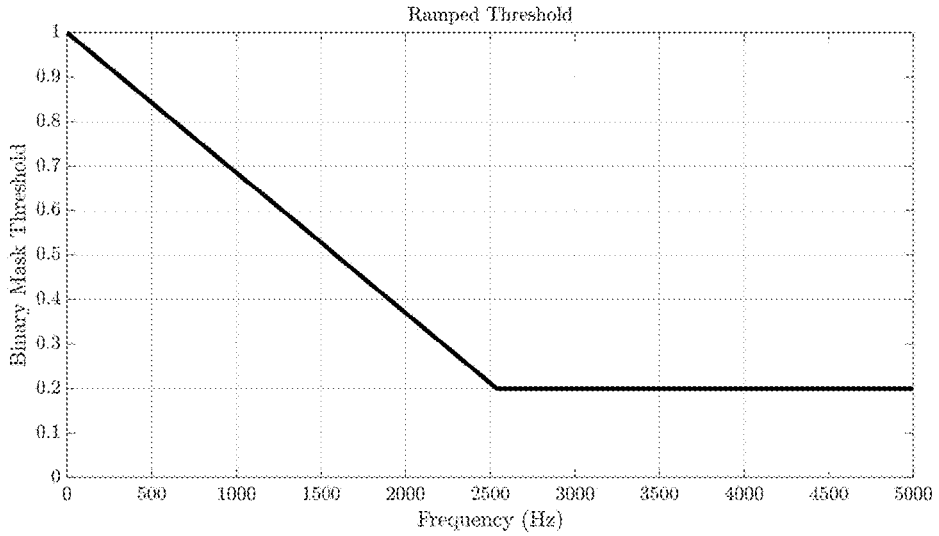
FIG. 7 is a plot for a ramped threshold used in STTC processing.

FIG. 7 shows an example ramped threshold used to compute the Binary Mask $BM_{1,2}$ for the most widely spaced pair of microphones, as mentioned above. For frequencies below 2500 Hz, the threshold ramps lin-early. This ramped threshold for the 6-microphone array is somewhat more aggressive than might be used in other embodiments, for example with an 8-microphone array as described below. The use of a ramped threshold improves cancellation performance for distractors located at off-axis angles of approximately 30°.

Figure 8:
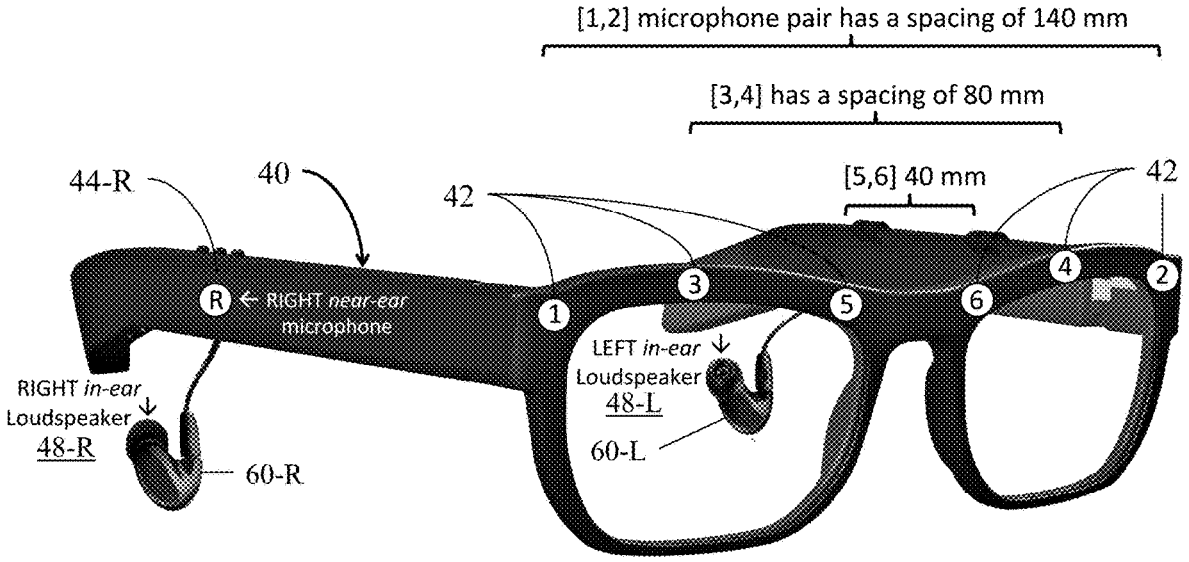
FIG. 8 is a depiction of a specialized eyeglass frame incorporating components of an ALD according to an alternative arrangement.

FIG. 8 illustrates an alternative physical realization in which the near-ear micron phones [44] are located on the temple pieces of the frame [40] rather than in the earbuds [60]. FIG. 8 shows only the right near-ear microphone [44-R]; a similar placement on the left temple piece is used for the left near-ear microphone [44-L].

An STTC ALD as described herein can improve speech intelligibility for a target talker while preserving Interaural Time Difference (ITD) and Interaural Level Difference (ILD) binaural cues that are important for spatial hearing. These binaural cues are not only important for effecting sound source localization and segregation, they are important for a sense of Spatial Awareness. While the processing described herein aims to eliminate the interfering sound sources altogether, the user of the STTC ALD device could choose whether to listen to the unprocessed waveforms at the Left and Right near-ear microphones, the processed waveforms, or some combination of both. The binaural cues that remain after filtering with the Time-Frequency (T-F) mask are consistent with the user's natural binaural cues, which allows for continued Spatial Awareness with a mixture of the processed and unprocessed waveforms. The ALD user might still want to hear what is going on in the surroundings, but will be able to turn the surrounding interferring sound sources down to a comfortable and ignorable, rather than distracting, intrusive and overwhelming, sound level. For example, in some situations, it would be helpful to be able to make out the speech of surrounding talkers, even though the ALD user is primarily focused on listening to the person directly in front of them.

Brief Summary of the STTC Assistive Listening Device Embodiment of the Invention.

An Assistive Listening Device (ALD) embodiment of the claimed invention computes a ratio mask in real-time using signals from microphones and Fast Fourier Transforms (FFTs) thereof, and without any knowledge about the noise source(s). As set forth in ¶0025-0045, the invention's Ratio Mask RM[n, k] can be computed using the Short-Time Fourier Transforms (STFTs) of signals from a microphone pair (e.g., i=[1, 2]):

$$RM[n,k] = \frac{\overbrace{|X_1[n,k]| + |X_2[n,k]|}^{\text{Mixture estimate } \hat{M}} - \overbrace{|X_1[n,k] - X_2[n,k]|}^{\text{Noise estimate } \hat{N}}}{\underbrace{|X_1[n,k]| + |X_2[n,k]|}_{\text{Mixture estimate } \hat{M}}} \tag{20}$$

The Mixture ($\hat{M}$) and Noise ($\hat{N}$) terms are short-time spectral magnitudes used to estimate the Ideal Ratio Mask (IRM) for multiple frequency channels [k] in each analysis frame [n]. The resulting Ratio Mask RM[n, k] is a vector of frequency channel weights for each analysis frame. An embodiment of the invention, an eyeglass-integrated assistive listening device, is shown in FIGS. 4-6. Multiple pairwise ratio masks can be computed for multiple microphone pairs (e.g., [1,2], [3,4], [5,6]) with varied spacings. A chimeric Global Ratio Mask ($RM_G$) can be constructed in a piecewise manner (see FIGS. 5 and 6), selecting a range of frequency channels from the individual pairwise ratio masks, so as to provide a positive absolute phase difference for the processing to work with.

Absolute phase differences for three microphone spacings (140, 80 and 40 mm) and three Direction of Arrival (DOA) angles (±30, ±60, ±90) are plotted in the top row of FIG. 5. There is an interaction between frequency, microphone spacing and Direction of Arrival angle (θ) that yields wrapped [π, π] absolute phase differences of zero at specific frequencies. Where the phase difference is at or near zero, the target cancellation approach is ineffective, as the interfering sound sources are cancelled at these frequencies and thereby are erroneously included in the frequency-domain signal estimate ($\hat{S}=\hat{M}-\hat{N}$). Multiple microphone pairs are used to overcome this null phase difference problem and thereby improve performance. This is further illustrated in FIG. 9 for a mixture of three concurrent talkers (compare FIGS. 5, 6 and 9).

Figure 9:
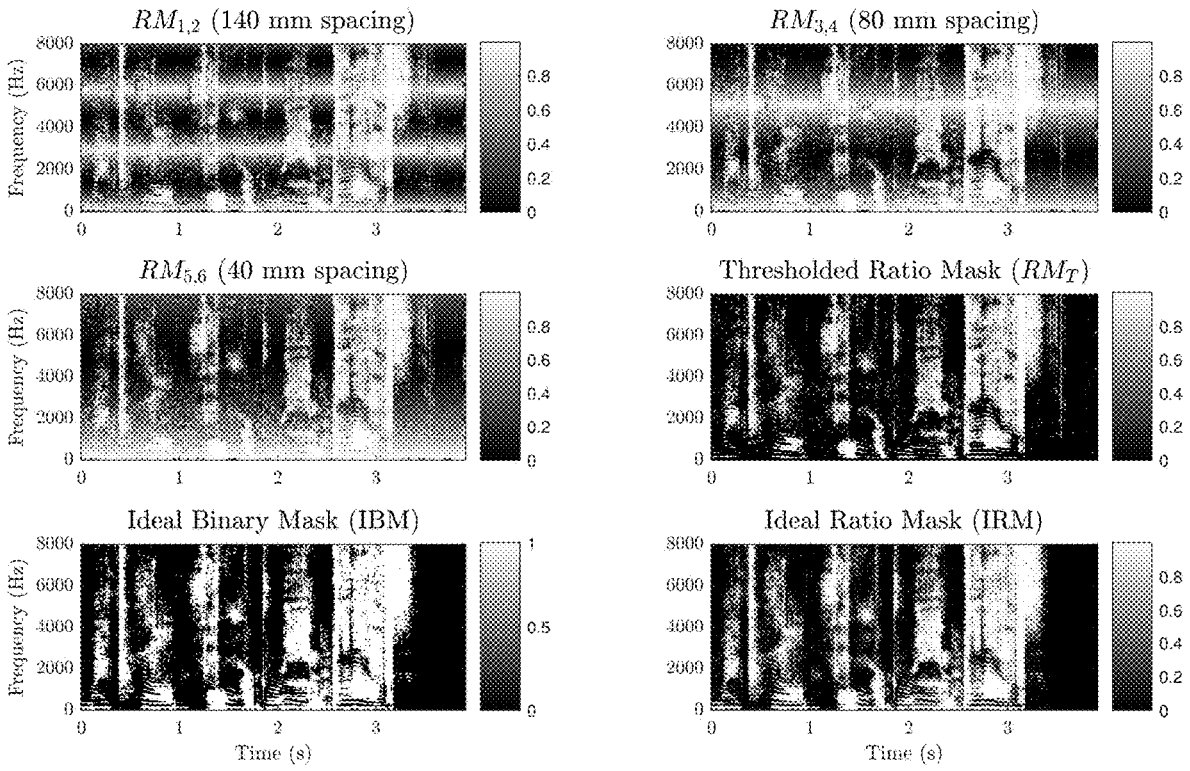
FIG. 9 is a demonstration figure with example Time-Frequency (T-F) masks for a mixture of three concurrent talkers.

Example Time-Frequency (T-F) masks for a mixture of three talkers are shown in FIG. 9. The three concurrent talkers were at −60°, 0° and +60°, with all three talkers at equal loudness. The target talker was "straight ahead" at 0° and the two interfering talkers were to the left and right at ±60°. The Ratio Masks from the three microphone pairs ([1,2], [3,4] and [5,6]) are shown in the first three panels. For each of these three Ratio Masks ($RM_{1,2}$, $RM_{3,4}$ and $RM_{5,6}$), there are frequencies at which there is no phase difference between target and interferer, resulting in bands of T-F tiles with (incorrect) values of (or near) "1" (see horizontal whitebands in the first three panels). However, multiple T-F masks from the three microphone pairs can be interfaced to yield a T-F mask (fourth panel) that is similar in appearance to ideal masks (bottom panels) that are computed using "oracle knowledge" of the signal and noise components in the mixture. In this example, the Thresholded Ratio Mask ($RM_T$) is a post-processed variant of the Global Ratio Mask ($RM_G$). Both the Global Ratio Mask ($RM_G$) and the Thresholded Ratio Mask ($RM_T$), (see FIG. 9) are effective time-varying filters, with a vector of frequency channel weights for every analysis frame.

The processing computes multiple pairwise ratio masks for multiple microphone spacings (e.g., 140, 80 and 40 mm). Each of the three Ratio Masks ($RM_{1,2}$, $RM_{3,4}$ and $RM_{5,6}$) has frequency bands where the T-F tiles are being overestimated (see horizontal white bands with values of "1" in FIG. 9). However, the multiple pairwise ratio masks can be interfaced (FIGS. 5 and 6) to compute a chimeric (i.e., composite) T-F mask which can look similar to the Ideal Ratio Mask (IRM) (see FIG. 9). Only the signals from the microphones (see FIG. 6) were used as input, whereas the IRM, which has a transfer function equivalent to a time-varying Weiner filter, is granted access to the component Signal (S) and Noise (N) terms:

$$IRM(t,f) = \frac{S^2(t,f)}{S^2(t,f) + N^2(t,f)} \tag{21}$$

where $S^2(t, f)$ and $N^2(t, f)$, are the signal (i.e., target speech) energy and noise energy, respectively; i.e., the Ideal Ratio Mask has "oracle knowledge" of the signal and noise components. The STTC ALD is capable of computing a T-F mask, in real-time, that is similar to the IRM (see FIG. 9), and does so without requiring any information about the noise source(s).

The hard problem here is not the static noise sources (think of the constant hum of a refrigerator); the real challenge is competing talkers, as speech has spectrotemporal variations that established approaches have difficulty suppressing. Stationary noise has a spectrum that does not change over time, whereas interfering speech, with its spectrotemporal fluctuations, is an example of non-stationary noise. Because the assistive listening device computes a time-varying filter in real-time, it can attenuate both stationary and non-stationary sound sources.

The invention employs causal and memoryless "frame-by-frame" processing; i.e., the T-F masks are computed using only the information from the current short-time analysis frame. Because of this, it is suitable for use in assistive listening device applications, which require causal and computationally efficient (i.e., FFT-based) low-latency (≤20 ms) processing. The assistive listening device's time-varying filtering, which can attenuate both stationary and non-stationary noise, can be applied on a frame-by-frame basis to signals at the Left and Right ears, thereby effecting real-time (and low-latency) sound source segregation that can enhance speech intelligibility for a target talker, while still preserving binaural cues for spatial hearing.

Figure 10:
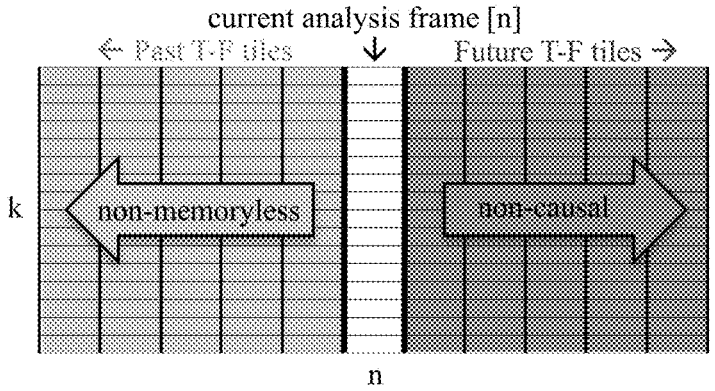
FIG. 10 is an illustration of causal and memoryless "frame by frame" processing.

The audio circuitry of the invention operates on a frame-by-frame basis, with processing that is both causal and memoryless; i.e., it does not use information from the future or the past. There are existing methods that can segregate competing talkers by computing a Time-Frequency (T-F) mask, which is effectively a time varying filter with a vector of frequency channel weights for every analysis frame. However, many of these methods, including Deep-Neural-Network (DNN) based approaches, use noncausal block processing to compute T-F tiles for each analysis frame. In order for an assistive listening device to operate on a "frame by frame" basis, it cannot use data from the future. This is illustrated in FIG. 10 for an example grid of T-F tiles with sixteen discrete frequency channels (k) and eleven short-time analysis frames (n); if the processing uses information from future T-F tiles (dark gray), it is noncausal; likewise, if it uses information from the past (light gray), it is non-memoryless. Causal and memoryless processing would consist of computing frequency channel (k) weights using data from only the current analysis frame (n).

These concerns regarding causality also relate to processing latencies for assistive listening devices. A device might violate the causality requirement by looking only a handful of frames into the future. However, one has to be mindful of the latency constraints; in order for an assistive listening device to be useful, the overall processing delay must be ≤20 ms (i.e., 1/50th of a second) for closed-fit hearing aids and ≤10 ms (i.e., 1/100th of a second) for open-fit hearing aids. If an assistive listening device were to look even just a few frames into the future, it would fail to meet these strict latency requirements.

Because the invention operates on a frame-by-frame basis, and the ratio mask computation requires only FFTs from microphone signals, the processing latency is determined by the length of the analysis window. An estimate of the processing latency is 2.5× the duration of the analysis window; this takes into account the fact that the Inverse Short-Time Fourier Transform (ISTFT) reconstruction requires two frames for Overlap-Add (OLA). Hence, a 20 ms latency for the invention can be achieved by using an 8 ms analysis window; likewise, a 10 ms latency can be achieved by using a 4 ms analysis window. The invention is capable of running in real-time with low latency. Equation 22 below is a variation of Equation 8 (and Equation 20) that further illustrates that the frame-by-frame computation is effected with vectors of frequency channel weights (k). Those skilled in the art of audio signal processing will understand that the STFTs in equation 8 (and equation 20) can be computed on a frame-by-frame basis using vectors (indicated by ":") of frequency channel (k) values for every analysis frame (n):

$$RM[n,:] = \frac{\overbrace{|X_1[n,:]| + |X_2[n,:]|}^{\text{Mixture estimate } \hat{M}} - \overbrace{|X_1[n,:] - X_2[n,:]|}^{\text{Noise estimate } \hat{N}}}{\underbrace{|X_1[n,:]| + |X_2[n,:]|}_{\text{Mixture estimate } \hat{M}}} \tag{22}$$

The invention computes a time-varying filter, in the form of a vector (:) of frequency channel (k) weights for every analysis frame (n), using only the data from the current analysis frame. As such, it is causal, memoryless, is capable of running in real time, and can be used to attenuate both stationary and non-stationary sound sources. The invention computes a real-time ratio mask, and does so with efficient low-latency frame-by-frame processing.

Using a Phase Difference Normalization Vector (PDNV) to Scale the Noise Estimate.

A variation on the processing described in ¶0025-0045 of this and the original specification, and summarized herein in ¶0056-0064, involves scaling the Noise estimate ($\hat{N}$) used to compute a pairwise Ratio Mask (RM) by what is hereby referred to as a discrete-frequency (k) dependent Phase Difference Normalization Vector (PDNV), denoted as Γ[k] in Equation 23 below:

$$RM[n,k] = \frac{\overbrace{|X_1[n,k]| + |X_2[n,k]|}^{\text{Mixture estimate } \hat{M}} - \overbrace{\Gamma[k]}^{\text{PDNV}}\overbrace{|X_1[n,k] - X_2[n,k]|}^{\text{Noise estimate } \hat{N}}}{\underbrace{|X_1[n,k]| + |X_2[n,k]|}_{\text{Mixture estimate } \hat{M}}} \tag{23}$$

Note that Γ[k] is discrete-frequency (k) dependent but is not time-dependent, nor is it computed using signal values. For a known microphone spacing, Γ[k] can be pre-computed so as to scale and normalize the discrete-frequency (k) dependent elements of the Noise estimate ($\hat{N}$) for each analysis frame n. The scaling of the Noise estimate ($\hat{N}$) by Γ[k] is effected through element-wise multiplication, which is denoted by the symbol ⊙ in equation 24 below:

$$RM[n,:] = \frac{\overbrace{|X_1[n,:]| + |X_2[n,:]|}^{\text{Mixture estimate } \hat{M}} - \overbrace{\Gamma[:]}^{\text{PDNV}} \odot \overbrace{|X_1[n,:] - X_2[n,:]|}^{\text{Noise estimate } \hat{N}}}{\underbrace{|X_1[n,:]| + |X_2[n,:]|}_{\text{Mixture estimate } \hat{M}}} \tag{23}$$

Those skilled in the art of audio signal processing will understand that the STFTs in equations 23 and 24 can be computed on a frame-by-frame basis using vectors (indicated by ":" in equation 24) of frequency channel (k) values for every analysis frame (n). To summarize, the pairwise noise estimate ($\hat{N}$) used to compute a pairwise ratio mask (RM) is scaled by a pre-computed frequency-dependent Phase Difference Normalization Vector (PDNV) Γ[k], which normalizes the noise estimate ($\hat{N}$), at each discrete frequency (k), in a manner dependent on the value of the maximum possible phase difference, at each discrete frequency (k), for a given microphone pair spacing.

A Phase Difference Normalization Vectors (PDNV) Γ[k] can be computed for a given microphone spacing. Assuming a distant sound source, the Time Difference of Arrival (TDOA) for a sensor pair is computed as follows, where d is the distance in meters between the two microphones, λ is the speed of sound in m/s and θ is the DOA angle in radians:

$$\tau = \frac{d}{\lambda}\sin(\theta) \tag{25}$$

The corresponding wrapped absolute phase difference (ρ), as a function of frequency (f) in Hz, and as plotted in the top row of FIG. 5, can be computed as follows:

$$\rho(f) = |\angle e^{j2\pi\tau f_c}| \tag{26}$$

where ∠ indicates the phase angle wrapped to the interval [−π, π]. Likewise, the discrete-frequency wrapped absolute phase difference ($\mathcal{P}$), as a function of discrete frequency ($w_k$), for a microphone pair spacing d, and a DOA angle θ in radians, can be computed as follows:

$$\mathcal{P}[k] = \left|\angle e^{j2\pi w_k \frac{d}{\lambda}\sin(\theta)}\right| \tag{27}$$

A discrete-frequency Phase Difference Normalization Vector (PDNV) Γ[k] can be pre-computed, for a given microphone pair spacing (d), for a given maximum possible angular separation ($\theta_{max}$) in radians, and for a scaling parameter β (for now, β=1), as being equivalent to the inverse of the discrete-frequency wrapped absolute phase difference below a given Frequency cutoff ($F_c$):

$$\Gamma[k] = \begin{cases} \dfrac{1}{\mathcal{P}[k]} = \left(\left|\angle e^{j2\pi w_k \beta \frac{d}{\lambda}\sin(\theta_{max})}\right|\right)^{-1}, & \text{if } \omega_k \le F_c \text{ Hz} \\ 1, & \text{if } \omega_k > F_c \text{ Hz} \end{cases} \tag{28}$$

Below the pre-determined frequency cutoff $F_c$, Γ[k] is inversely proportional to the discrete-frequency wrapped absolute phase difference $\mathcal{P}$ (see equation 27) at the maximum possible angular separation of $\theta_{max}$. The pre-computed frequency-dependent PDNV Γ[k], is used to scale (i.e., normalize) the Noise ($\hat{N}$) term in a manner dependent on the value of the maximum possible phase difference, at each discrete frequency (k), for a given microphone pair spacing.

Alternative STTC Processing [52] with Phase Difference Normalization

Pairwise ratio masks RM, one for each microphone spacing (140, 80 and 40 mm) can also be calculated as follows; i.e., there is a unique RM for each pair of microphones ([1,2], [3,4], [5,6]):

$$RM_{1,2}[n, k] = \frac{|X_1[n,k]| + |X_2[n,k]| - \Gamma_{[1,2]}[k]|X_1[n,k] - X_2[n,k]|}{|X_1[n,k]| + |X_2[n,k]|} \tag{29a}$$

$$RM_{3,4}[n, k] = \frac{|X_3[n,k]| + |X_4[n,k]| - \Gamma_{[3,4]}[k]|X_3[n,k] - X_4[n,k]|}{|X_3[n,k]| + |X_4[n,k]|} \tag{29b}$$

-continued $$RM_{5,6}[n, k] = \frac{|X_5[n,k]| + |X_6[n,k]| - \Gamma_{[5,6]}[k]|X_5[n,k] - X_6[n,k]|}{|X_5[n,k]| + |X_6[n,k]|} \tag{29c}$$

A pairwise Phase Difference Normalization Vector (PDNV) Γ[k], which scales the respective pairwise Noise ($\hat{N}$) estimate, can be pre-computed for each microphone pair spacing:

$$\Gamma_{[1,2]}[k] = \begin{cases} \dfrac{1}{\mathcal{P}_{[1,2]}[k]} = \left(\left|\angle e^{j2\pi w_k \beta \frac{d_{1,2}}{\lambda}\sin(\theta_{max})}\right|\right)^{-1}, & \text{if } \omega_k \le 1000 \text{ Hz} \\ 1, & \text{if } \omega_k > 1000 \text{ Hz} \end{cases} \tag{30a}$$

$$\Gamma_{[3,4]}[k] = \begin{cases} \dfrac{1}{\mathcal{P}_{[3,4]}[k]} = \left(\left|\angle e^{j2\pi w_k \beta \frac{d_{3,4}}{\lambda}\sin(\theta_{max})}\right|\right)^{-1}, & \text{if } \omega_k \le 2000 \text{ Hz} \\ 1, & \text{if } \omega_k > 2000 \text{ Hz} \end{cases} \tag{30b}$$

$$\Gamma_{[3,4]}[k] = \begin{cases} \dfrac{1}{\mathcal{P}_{[5,6]}[k]} = \left(\left|\angle e^{j2\pi w_k \beta \frac{d_{5,6}}{\lambda}\sin(\theta_{max})}\right|\right)^{-1}, & \text{if } \omega_k \le 4000 \text{ Hz} \\ 1, & \text{if } \omega_k > 4000 \text{ Hz} \end{cases} \tag{30c}$$

Figure 11:
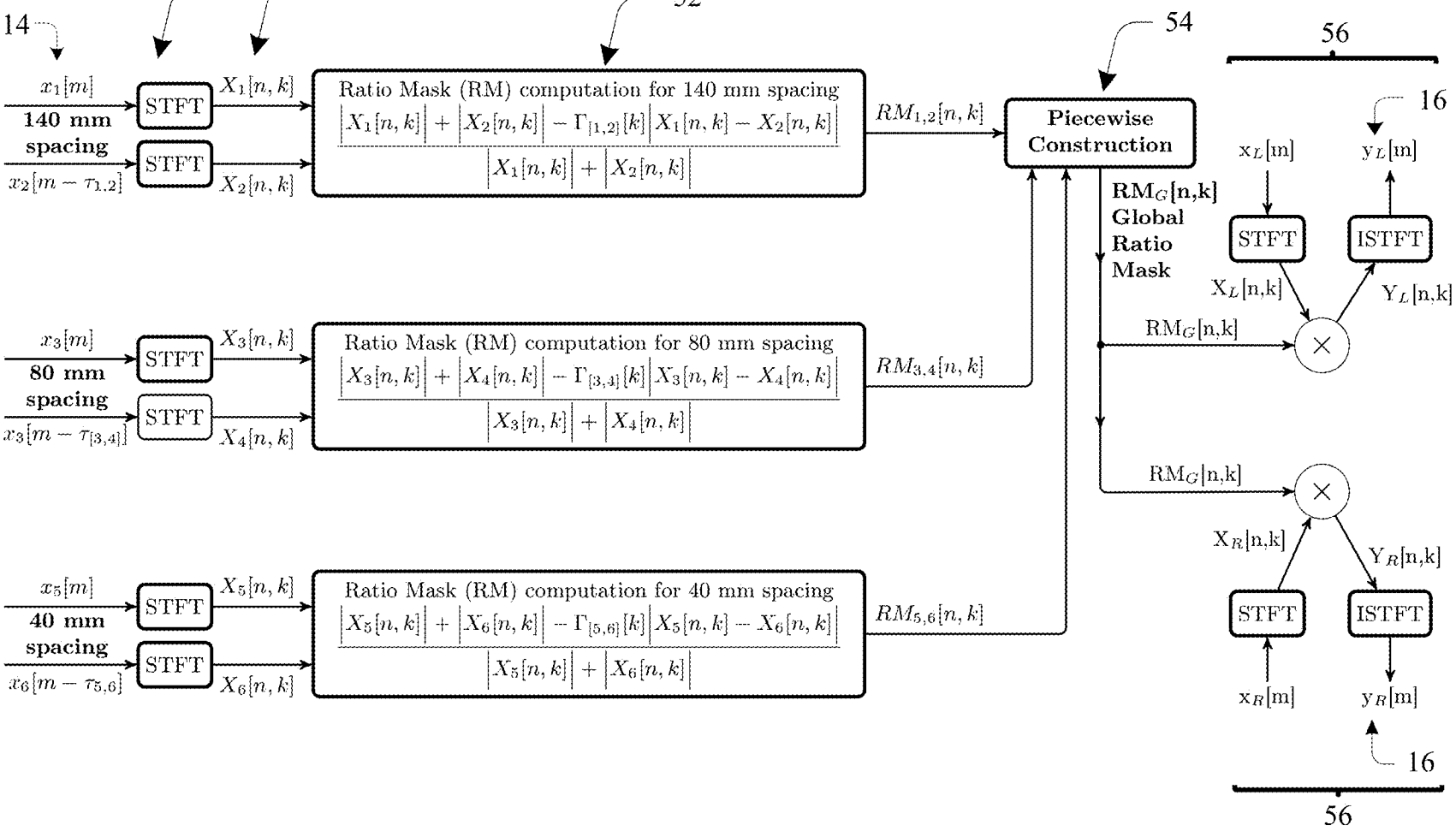
FIG. 11 is a block diagram of alternative STTC processing for an ALD.

Below a pre-determined frequency cutoff, Γ[k] is inversely proportional to the discrete-frequency wrapped absolute phase difference $\mathcal{P}$ (see equation 27) at a maximum possible angular separation of $$\theta_{max} = \frac{\pi}{2}$$

radians. Although the PDNV Γ[k] can be equivalent to the inverse of $\mathcal{P}$ across all discrete frequencies $w_k$, here Γ[k] is set to unity at and above a pre-determined frequency cutoff (see equation 30). This alternative processing, for the STTC ALD "listening glasses" shown in FIG. 4, is illustrated in the block diagram in FIG. 11 (compare FIGS. 6 and 11).

Alternative Embodiments of the STTC Assistive Listening Device (ALD).

Further theme and variation, with varied placement of the microphones used to compute the pairwise ratio masks, is described below and shown in FIGS. 12 through 16. As with the first example embodiment of the STTC Assistive Listening Device (ALD), described on the previous pages, the pairwise Ratio Masks (RM) are computed using pairs of microphones, with varied spacings, that are integrated into the frame of a pair of eyeglasses.

Figure 12:
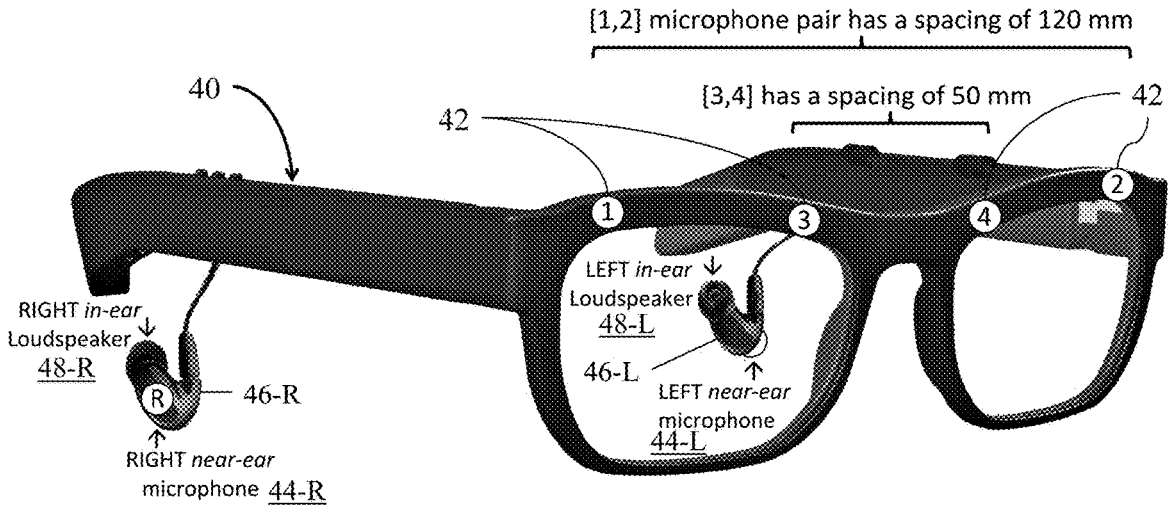
FIG. 12 is a depiction of a second example embodiment of an ALD.

FIG. 12 shows a second example physical realization of an assistive listening device or ALD, specifically as a set of microphones and loudspeakers incorporated in an eyeglass frame [40] worn by a user. In this realization, the microphones [10] are realized using four forward-facing microphones [42] and two near-ear microphones [44-R], [44-L]. The forward-facing microphones [42] are enumerated 1-4 as shown, and functionally arranged into pairs 1-2 and 3-4, with respective distinct intra-pair spacings of 120 mm and 50 mm respectively in this embodiment. The near-ear microphones [44] are included in respective right and left earbuds [46-R], [46-L] along with corresponding in-ear loudspeakers [48-R], [48-L].

Generally, the inputs from the four eyeglass-integrated microphones [42] are used to compute a Time-Frequency (T-F) mask (i.e. time-varying filter), which is used to attenuate non-target sound sources in the Left and Right near-ear microphones [44-L], [44-R]. The device boosts speech intelligibility for a target talker [13-T] from a designated look direction while preserving binaural cues that are important for spatial hearing.

Figure 13:
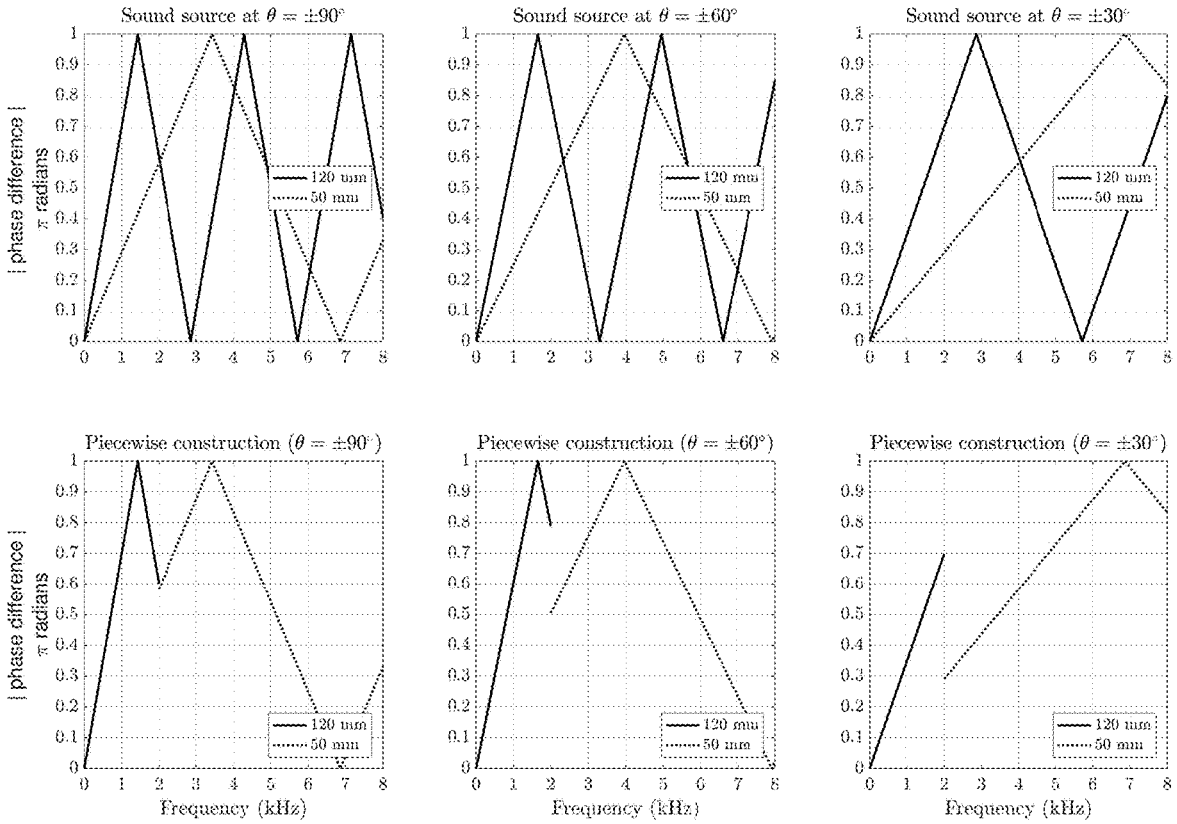
FIG. 13 is a second plot of phase separations, for microphone pairs of an ALD such as that of FIG. 12.

FIG. 13 illustrates one aspect of the disclosed technique, namely addressing the problem of "null phase differences" that impair performance within certain frequencies for any one pair of microphones. The top panel illustrates the phase separations for two microphone spacings across the frequency range of 0 to 8 kHz, and for three different interfering sound source directions (30°, 60° and 90°). For each microphone pair with respective intra-pair microphone spacing, there are frequencies at which there is little to no phase difference, such that target cancellation based on phase differences cannot be effectively implemented. The disclosed technique employs multiple microphone pairs, with varied spacings, to address this issue.

In the illustrated example shown in FIG. 13, two microphone pairs having respective distinct spacings (e.g. 120 and 50 mm) are used, and their outputs are combined via "piecewise construction", as illustrated in the bottom panel of FIG. 13; i.e., combined in a manner that provides positive absolute phase differences for the STTC processing to work with in the 0-8 kHz band that is most important for speech intelligibility. In particular, this plot illustrates the "piecewise construction" approach to creating a chimeric Global Ratio Mask $RM_G$ from the individual Ratio Masks for the two microphone pairs ([1, 2], [3, 4]).

Figure 14:
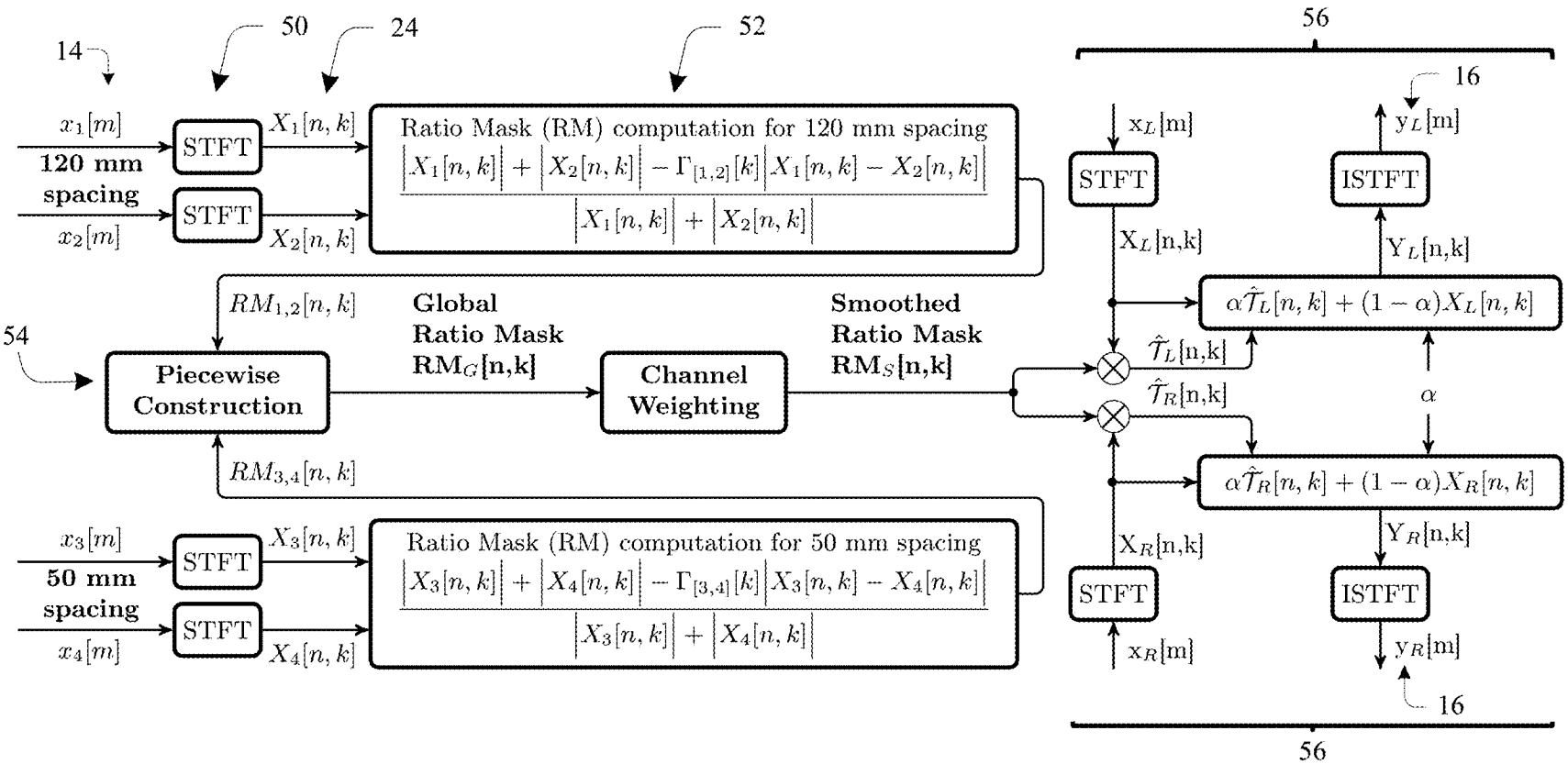
FIG. 14 is a block diagram of the alternative STTC processing used in this second example embodiment of an ALD, such as that of FIG. 12.

FIG. 14 is a block diagram of the alternative STTC processing used in this second example embodiment of an ALD. Overall, it includes the following distinct stages of calculations:

1. Short-Time Fourier Transform (STFT) processing [50], converts each microphone signal into frequency domain signal
2. Ratio Mask (RM) processing [52], applied to frequency domain signals of microphone pairs
3. Piecewise Construction of a Global Ratio Mask ($RM_G$) [54] processing, uses ratio masks of all microphone pairs
4. Output signal processing [56], uses the Global Ratio Mask ($RM_G$), or a post-processed variant thereof, to scale/modify selected microphone signals to serve as output signal(s) [16]

In this second example embodiment of the STTC ALD, alternative STTC processing, post-processing and time-domain signal reconstruction is illustrated in FIG. 14. Each of the two microphone pairs ([1,2], [3,4]) yields a Ratio Mask ($RM_{1,2}$ and $RM_{3,4}$). The chimeric Global Ratio Mask $RM_G$ has the 0 to 2 kHz (i.e., "low to mid") frequency channels from $RM_{1,2}$ and the 2 khz to F/2 (i.e., "mid to high") frequency channels from $RM_{3,4}$. $RM_G$ is smoothed along the frequency axis to yield the Smoothed Ratio Mask $RM_S$. Hence, $RM_S$ is a post-processed variant of $RM_G$. Either $RM_G$ or $RM_S$ (i.e., the smoothing along the frequency axis step is optional) can be used to attenuate the interfering (i.e., non-target) talkers in the binaural sound mixtures ($x_L$ and $x_R$) from microphones in the Left and Right ears, thereby effecting real-time sound source segregation (and a predicted enhancement of target talker speech intelligibility) while still preserving binaural cues for spatial hearing.

The alternative STTC processing (FIG. 14) for this second example embodiment of an STTC ALD uses two pairs of microphones with varied spacing (120 and 50 mm); each of these two microphone spacings is free from null phase differences within a different range of frequencies (FIG. 13). A "piecewise construction" approach to avoiding null phase differences is illustrated in the bottom row of FIG. 13. The approach described herein uses two pairs ([1,2] and [3, 4]) to compute two Ratio Masks ($RM_{[1,2]}$ and $RM_{[3,4]}$):

$$RM_{1,2}[n,\ k] = \frac{|X_1[n,k]| + |X_2[n,k]| - \Gamma_{[1,2]}[k]|X_1[n,k] - X_2[n,k]|}{|X_1[n,k]| + |X_2[n,k]|} \tag{31a}$$

$$RM_{3,4}[n,\ k] = \frac{|X_3[n,k]| + |X_4[n,k]| - \Gamma_{[3,4]}[k]|X_3[n,k] - X_4[n,k]|}{|X_3[n,k]| + |X_4[n,k]|} \tag{31b}$$

A pairwise Phase Difference Normalization Vector (PDNV) Γ[k], which scales the respective Noise $\hat{N}$ terms, can be pre-computed for each microphone pair spacing:

$$\Gamma_{[1,2]}[k] = \begin{cases} \dfrac{1}{\mathcal{P}_{[1,2]}[k]} = \left(\left|{}_{L}e^{j2\pi w_k \beta \frac{d_{1,2}}{\lambda} \sin(\theta_{max})}\right|\right)^{-1}, & \text{if } \omega_k \le 1250 \text{ Hz} \\ 1, & \text{if } \omega_k > 1250 \text{ Hz} \end{cases} \tag{32a}$$

$$\Gamma_{[3,4]}[k] = \begin{cases} \dfrac{1}{\mathcal{P}_{[3,4]}[k]} = \left(\left|{}_{L}e^{j2\pi w_k \beta \frac{d_{3,4}}{\lambda} \sin(\theta_{max})}\right|\right)^{-1}, & \text{if } \omega_k \le 3250 \text{ Hz} \\ 1, & \text{if } \omega_k > 3250 \text{ Hz} \end{cases} \tag{32b}$$

Below a pre-determined frequency cutoff, the pairwise Γ[k] is inversely proportional to the discrete-frequency wrapped absolute phase difference $\mathcal{P}$ (see equation 27) at the maximum possible angular separation of $\theta_{max}=\pi/2$ radians. The frequency dependent PDNV Γ[k], is used to scale (or normalize) the Noise ($\hat{N}$) term according to how little phase difference is available at each discrete frequency $w_k$. This helps alleviate the problem of having very little phase difference, for the STTC processing to work with, at relatively low frequencies. Although the PDNV Γ[k] can be equivalent to the inverse of $\mathcal{P}$ across all discrete frequencies $w_k$, here Γ[k] is set to unity at and above a predetermined frequency (see equation 32).

The two eyeglass-integrated microphone pairs ([1, 2], [3, 4]) yield two unique ratio masks ($RM_{1,2}$, $RM_{3,4}$), which are interfaced with each other so as to provide a positive absolute phase difference for STTC processing to work with (see bottom row of FIG. 13). The "piecewise construction" approach to creating a chimeric Global Ratio Mask $RM_G$ from the individual Ratio Masks for the two microphone pairs ([1,2], [3,4]) is illustrated in FIGS. 13 and 14. $RM_G$ can be constructed, in a piece-wise manner, as follows when using a sampling rate of $F_s$=32 kHz and short-time analysis windows of 4 ms duration:

$$RM_G[n, 1:8] = RM_{1,2}[n, 1:8] \ (\approx 0 \rightarrow 2000 \text{ Hz})$$

$$RM_G\left[n, 9:\frac{F}{2}\right] = RM_{3,4}\left[n, 9:\frac{F}{2}\right] \left(\approx 2000 \rightarrow \frac{F_S}{2} \text{ Hz}\right)$$

$$RM_G[n,k] = RM_G[n,k]^+$$

The positive exponent (i.e., $RM_G[n, k]^+$) indicates that any negative T-F values in $RM_G$ are set to zero. The piecewise-constructed Global Ratio Mask $RM_G$ is also given conjugate symmetry (i.e., negative frequencies are the mirror image of positive frequencies). This ensures that the processing yields a real (rather than complex) output.

Because of the fundamental tradeoff between spectral and temporal resolution, when using a relatively short analysis window, the resolution along discrete-frequency can be rather course, which unfortunately can result in rather subpar and unpleasant speech quality. However, the speech quality can be improved by "Channel Weighting", which consists of smoothing along the frequency axis. This "frequency smoothing" can be effected in various ways, for example through use of a mean filter or convolution with a gamma-tone weighting function. When using relatively long analysis windows, this post-processing step is not necessary or useful. However, when using relatively short analysis windows, this "Channel Weighting" (i.e., smoothing along the frequency axis) post-processing step can noticeably improve speech quality. As illustrated in FIG. 14, $RM_G$, is smoothed along the frequency axis to yield the Smoothed Ratio Mask $RM_S$. Hence, $RM_S$ is a post-processed variant of $RM_G$. Either $RM_G$ or $RM_S$ (i.e., the channel weighting step is optional) can be used to attenuate the interfering (i.e., non-target) talkers in the binaural sound mixtures ($x_L$ and $x_R$) from microphones in the Left and Right ears.

The output of the STTC processing is an estimate of the target speech signal from the specified look direction. The Left and Right (i.e. stereo pair) Time-Frequency domain estimates ($\hat{\tau}_L[n, k]$ and $\hat{\tau}_R[n, k]$) of the target speech signal can be described thusly, where $X_L$ and $X_R$ are the Short Time Fourier Transforms (STFTs) of the signals $x_L$ and $x_R$, from the designated Left and Right microphones, and $RM_S[n, k]$ is the conjugate-symmetric Smoothed Ratio Mask (i.e., the set of short-time weights for all frequencies, both positive and negative):

$$\hat{\tau}_L[n,k]=RM_S[n,k]\times X_L[n,k]\ \hat{\tau}_R[n,k]=RM_S[n,k]\times X_R[n,k] \tag{33}$$

Those skilled in the art of audio signal processing will understand that $RM_G$, or any post-processed variant thereof, can be used to compute the output of STTC processing:

$$\hat{\tau}_L[n,k]=RM_G[n,k]\times X_L[n,k]\ \hat{\tau}_R[n,k]=RM_G[n,k]\times X_R[n,k] \tag{34}$$

A user-defined "mix" parameter $\alpha$ would allow the user of an STTC "Assistive Listening Device" to determine the ratio of processed and unprocessed output. With $\alpha=0$, only unprocessed output would be heard, whereas with $\alpha=1$ only processed (i.e., the output of the STTC processing described herein) would be heard. At intermediate values, a user-defined ideal mix of processed and unprocessed output could be defined by the user, either beforehand or online using a smartphone application. The frequency-domain stereo output ($[Y_L, Y_R]$) would thus be some user-defined mixture of processed ($[\hat{\tau}_L, \hat{\tau}_R]$) and unprocessed ($[X_L, X_R]$) audio:

$$Y_L[n,k]=\alpha\hat{\tau}_R[n,k]+(1-\alpha)X_R[n,k]$$

$$Y_R[n,k]=\alpha\hat{\tau}_R[n,k]+(1-\alpha)X_R[n,k]$$

Synthesis of a stereo output ($y_L$ [m] and $y_R$[m]) estimate of the target speech signal consists of taking the Inverse Short Time Fourier Transforms (ISTFTs) of $Y_L[n, k]$ and $Y_R[n, k]$ and using the overlap-add method of reconstruction. Alternative processing would involve using $RM_S$ as a postfilter for a fixed and/or adaptive beamformer, and giving the user control over the combination of STTC processing, beamforming, and unprocessed audio.

Figure 15:
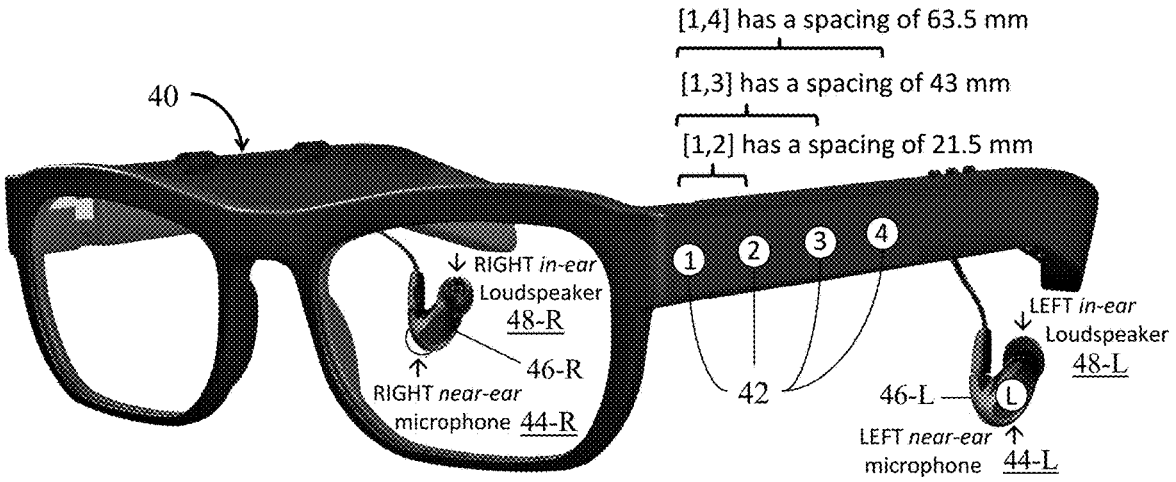
FIG. 15 is a depiction of a third example embodiment of an ALD.

FIG. 15 shows a third example physical realization of an assistive listening device or ALD, specifically as a set of microphones and loudspeakers incorporated in an eyeglass frame [40] worn by a user. In this realization, the microphones [10] are realized using four eyeglass-integrated microphones [42], arranged on the left temple piece (i.e., stem) of the eyeglass frames, and two near-ear microphones [44-R], [44-L]. The four eyeglass-integrated microphones [42] are enumerated 1-4 as shown, and functionally arranged into three pairs 1-2, 1-3 and 1-4, with respective distinct intra-pair spacings of 21.5 mm, 43 mm and 64.5 mm respectively, in this embodiment. The near-ear microphones [44] are included in respective right and left earbuds [46-R], [46-L] along with corresponding in-ear loudspeakers [48-R], [48-L].

Generally, the inputs from the four eyeglass-integrated microphones [42] are used to compute a Time-Frequency (T-F) mask (i.e. time-varying filter), which is used to attenuate non-target sound sources in the Left and Right near-ear microphones [44-L], [44-R]. The device boosts speech intelligibility for a target talker [13-T] from a designated look direction while preserving binaural cues that are important for spatial hearing.

Figure 16:
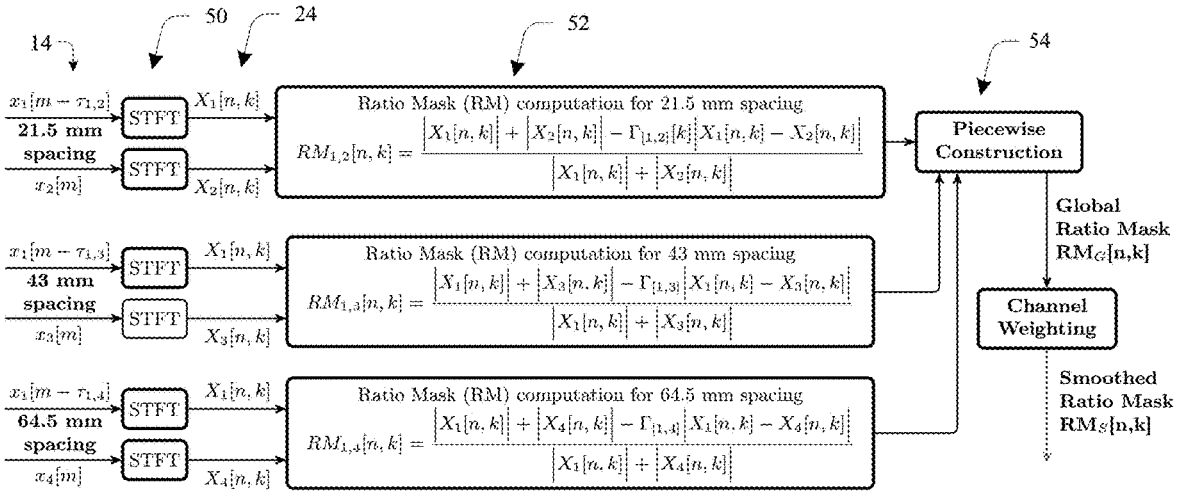
FIG. 16 is a block diagram of the alternative STTC processing used in a third example embodiment of an ALD, such as that of FIG. 15.

FIG. 16 is a block diagram of the alternative STTC processing used in this third example embodiment of an ALD. Overall, it includes the following distinct stages of calculations:

1. Short-Time Fourier Transform (STFT) processing [50], converts each microphone signal into frequency domain signal 2. Ratio Mask (RM) processing [52], applied to frequency domain signals of microphone pairs 3. Piecewise Construction of a Global Ratio Mask ($RM_G$) [54] processing, uses ratio masks of all microphone pairs 4. Output signal processing, uses the Global Ratio Mask ($RM_G$), or a post-processed variant thereof, to scale/modify selected microphone signals to serve as output signal(s) (as in FIG. 14)

In this third example embodiment (see FIGS. 15 and 16) $\tau$ sample shifts, as described in ¶0051 herein and in the original specification, are used to steer the "look" direction of the eyeglass-integrated microphones by 90° (equivalent to $$\theta=\frac{\pi}{2}$$

radians); i.e., so as to steer the "look" direction towards a target directly in front of the ALD user.

The $\tau$ sample shifts are computed independently for each pair of microphones, where $F_s$ is the sampling rate, d is the inter-microphone spacing in meters, $\lambda$ is the speed of sound in meters per second and $\theta$ is the specified angular "look" direction in radians (here $$\theta=\frac{\pi}{2}):$$

$$\tau_{[1,2]}=\left\lfloor f_s\times\frac{d_{[1,2]}}{\lambda}\sin(\theta)\right\rfloor \tag{36a}$$

$$\tau_{[1,3]}=\left\lfloor f_s\times\frac{d_{[1,3]}}{\lambda}\sin(\theta)\right\rfloor \tag{36b}$$

$$\tau_{[1,4]}=\left\lfloor f_s\times\frac{d_{[1,4]}}{\lambda}\sin(\theta)\right\rfloor \tag{36c}$$

Because here we are shifting the "look" direction by 90° (i.e., $$\theta = \frac{\pi}{2})$$

via these pairwise τ sample shifts, it is in this case necessary to modify the computation of the discrete-frequency wrapped absolute wrapped phase difference ($\mathcal{P}$) so as to incorporate a scaling parameter β; here β=2.

A modified discrete-frequency wrapped absolute phase difference ($\mathcal{P}$), as a function of, discrete frequency ($w_k$) in Hz, DOA angle θ in radians, and here with a scaling parameter of β=2, can be computed as follows, where d is the microphone pair spacing in meters:

$$\mathcal{P}[k] = \left| \angle e^{j2\pi w_k \beta \frac{d}{\lambda} \sin(\theta)} \right| \tag{37}$$

A pairwise discrete-frequency Phase Difference Normalization Vector (PDNV) Γ[k] can be precomputed, for a given microphone pair spacing (d), and for a given maximum possible angular separation ($\theta_{max}$) in radians, as being equivalent to the inverse of the discrete-frequency wrapped absolute phase difference below a given Frequency cutoff ($F_c$):

$$\Gamma[k] = \begin{cases} \frac{1}{P[k]} = \left( \left| \angle e^{j2\pi w_k \beta \frac{d}{\lambda} \sin(\theta_{max})} \right| \right)^{-1}, & \text{if } \omega_k \le F_c \text{Hz} \\ 1, & \text{if } \omega_k > F_c \text{Hz} \end{cases} \tag{38}$$

Below the pre-determined frequency cutoff $F_c$, Γ[k] is inversely proportional to the discrete-frequency wrapped absolute phase difference $\mathcal{P}$ (see equation 37) at the maximum possible angular separation of $\theta_{max}$. The pre-computed frequency-dependent PDNV Γ[k], is used to scale (i.e., normalize) the Noise ($\hat{N}$) term in a manner dependent on the value of the maximum possible phase difference, at each discrete frequency (k), for a given microphone pair spacing.

As illustrated on the left hand side of FIG. 16, the τ sample shifts are used to delay $x_1$[m] before computing three different variants of $X_1$ [n, k]; although the same $X_1$ [n, k] notation is used for all three Ratio Mask (RM) computations, $X_1$[n, k] is in this case a local variable, computed uniquely for each of the three RM computations, because $x_1$ [m] is shifted by three different τ sample shifts ($\tau_{[1,2]}$, $\tau_{[1,3]}$, $\tau_{[1,4]}$) before the STFT stage that yields $X_1$ [n,k].

In this third example embodiment of the STTC ALD, alternative STTC processing is illustrated in FIG. 16. Each of the three microphone pairs ([1,2], [1,3], [1,4]) yields a Ratio Mask ($RM_{1,2}$ $RM_{1,3}$ and $RM_{1,4}$). Here the chimeric Global Ratio Mask $RM_G$ has the 0 to 1.5 kHz (i.e., "low to mid") frequency channels from $RM_{1,4}$, the 1.5 kHz to 3 kHz (i.e., "mid") frequency channels from $RM_{1,3}$ and the 3 khz to F/2 (i.e., "mid to high") frequency channels from $RM_{1,2}$.

The alternative STTC processing (FIG. 16) for this third example embodiment of an STTC ALD uses three pairs of microphones with varied spacing (21.5, 43 and 64.5 mm); each of these three microphone spacings is free from null phase differences within a different range of frequencies. The approach described herein uses three microphone pairs ([1, 2], [1,3] and [1, 4]) to compute three Ratio Masks ($RM_{[1,2]}$, $RM_{[1,3]}$ and $RM_{[1,4]}$).

$$RM_{1,2}[n, k] = \frac{|X_1[n, k]| + |X_2[n, k]| - \Gamma_{[1,2]}[k]|X_1[n, k] - X_2[n, k]|}{|X_1[n, k]| + |X_2[n, k]|} \tag{39a}$$

$$RM_{1,3}[n, k] = \frac{|X_1[n, k]| + |X_3[n, k]| - \Gamma_{[1,3]}[k]|X_1[n, k] - X_3[n, k]|}{|X_1[n, k]| + |X_3[n, k]|} \tag{39b}$$

$$RM_{1,4}[n, k] = \frac{|X_1[n, k]| + |X_4[n, k]| - \Gamma_{[1,4]}[k]|X_1[n, k] - X_4[n, k]|}{|X_1[n, k]| + |X_4[n, k]|} \tag{39c}$$

A pairwise Phase Difference Normalization Vector (PDNV) Γ[k], which scales the respective pairwise Noise ($\hat{N}$) estimate, can be pre-computed for each microphone pair spacing, using the modified PDNV computation in ¶0088 that incorporates a parameter β (here β=2):

$$\Gamma_{[1,2]}[k] = \begin{cases} \frac{1}{\mathcal{P}_{[1,2]}[k]} = \left( \left| \angle e^{j2\pi w_k \beta \frac{d_{1,2}}{\lambda} \sin(\theta_{max})} \right| \right)^{-1}, & \text{if } \omega_k \le 1000 \text{ Hz} \\ 1, & \text{if } \omega_k > 1000 \text{ Hz} \end{cases} \tag{40a}$$

$$\Gamma_{[1,3]}[k] = \begin{cases} \frac{1}{\mathcal{P}_{[1,3]}[k]} = \left( \left| \angle e^{j2\pi w_k \beta \frac{d_{1,3}}{\lambda} \sin(\theta_{max})} \right| \right)^{-1}, & \text{if } \omega_k \le 2000 \text{ Hz} \\ 1, & \text{if } \omega_k > 2000 \text{ Hz} \end{cases} \tag{40b}$$

$$\Gamma_{[1,4]}[k] = \begin{cases} \frac{1}{\mathcal{P}_{[1,4]}[k]} = \left( \left| \angle e^{j2\pi w_k \beta \frac{d_{1,4}}{\lambda} \sin(\theta_{max})} \right| \right)^{-1}, & \text{if } \omega_k \le 4000 \text{ Hz} \\ 1, & \text{if } \omega_k > 4000 \text{ Hz} \end{cases} \tag{40c}$$

Below a pre-determined frequency cutoff, Γ[k] is inversely proportional to the discrete-frequency wrapped absolute phase difference $\mathcal{P}$ (see equation 37) at the maximum possible angular separation of η=π/2 radians. The frequency dependent PDNV Γ[k], is used to scale (or normalize) the Noise ($\hat{N}$) term according to how little phase difference is available at each discrete frequency $w_k$. This helps alleviate the problem of having very little phase difference, for the STTC processing to work with, at relatively low frequencies. Although the PDNV Γ[k] can be equivalent to the inverse of $\mathcal{P}$ across all discrete frequencies $w_k$, here Γ[k] is set to unity at and above a pre-determined frequency (see equation 40).

The three eyeglass-integrated microphone pairs ([1, 2], [1, 3], [1, 4]) yield pairwise ratio masks ($RM_{1,2}$, $RM_{1,3}$, $RM_{1,4}$), which are interfaced with each other to construct the chimeric Global Ratio Mask ($RM_G$), which can be constructed via "Piecewise Construction" as follows when using a sampling rate of $F_s$=32 kHz and short-time analysis windows of 4 ms duration:

$$RM_G[n, 1{:}6] = RM_{1,4}[n, 1{:}6] \ (\approx 0 \rightarrow 1500 \text{ Hz})$$

$$RM_G[n, 7{:}12] = RM_{1,3}[n, 7{:}2] \ (\approx 1500 \rightarrow 3000 \text{ Hz})$$

$$RM_G\left[n, 13{:}\frac{F}{2}\right] = RM_{1,2}\left[n, 13{:}\frac{F}{2}\right] \left(\approx 3000 \rightarrow \frac{F_S}{2} \text{ Hz}\right)$$

$RM_G$[n, k]=$RM_G$[n, k]$^+$. The positive exponent (i.e., $RM_G$ [n, k]$^+$) indicates that any negative T-F values in $RM_G$ are set to zero. The piecewise-constructed Global Ratio Mask $RM_G$ is also given conjugate symmetry (i.e., negative frequencies are the mirror image of positive frequencies). This ensures that the processing yields a real (rather than complex) output.

II. System Description of 8-Microphone Short-Time Target Cancellation (STTC) Human-Computer Interface (HCI)

FIGS. 17-21 show a second embodiment of a computerized realization using 8 microphones. The STTC processing serves as a front end to a computer hearing application such as automatic speech recognition (ASR). Because much of the processing is the same or similar as that of a 6-microphone system as described above, the description of FIGS. 17-21 is limited to highlighting the key differences from corresponding aspects of the 6-microphone system.

Figure 17:
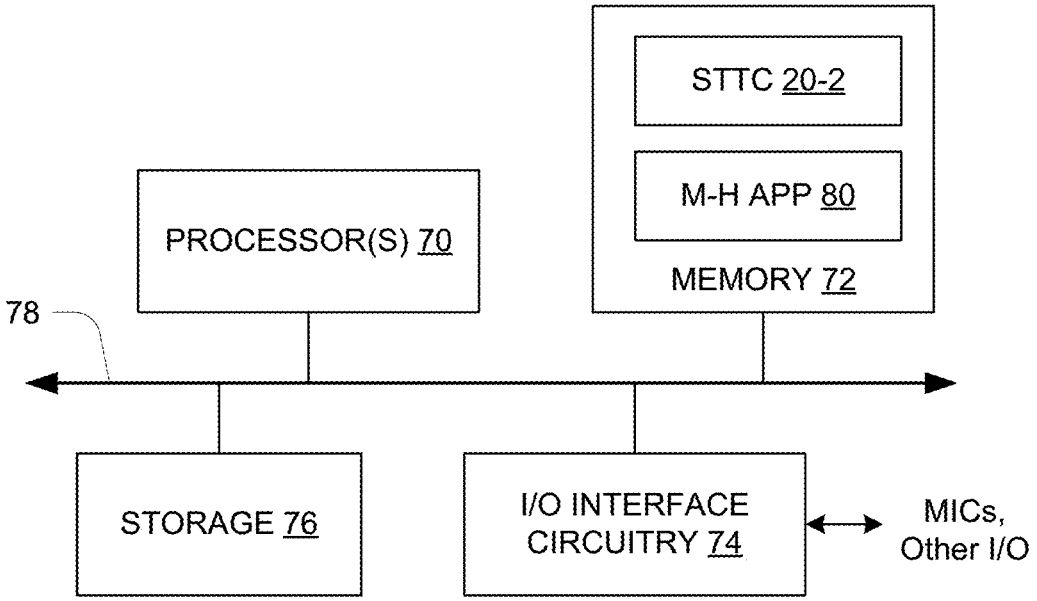
FIG. 17 (same as FIG. 9 in the original specification) is a block diagram of circuitry of a computerized device incorporating STTC processing for human-computer interface (HCI)

FIG. 17 is a block diagram of a specialized computer that realizes the STTC functionality. It includes one or more processors [70], primary memory [72], I/O interface circuitry [74], and secondary storage [76] all interconnected by high-speed interconnect [78] such as one or more high-bandwidth internal buses. The I/O interface circuitry [74] interfaces to external devices including the input microphones, perhaps through integral or non-integral analog-to-digital converters. In operation, the memory [72] stores computer program instructions of application programs as well as an operating system, as generally known. In this case, the application programs include STTC processing [20-2] as well as a machine hearing application (M-H APP) [80]. The remaining description focuses on structure and operation of the STTC processing [20-2], which generates noise-reduced output audio signals [16] (FIG. 1) supplied to the machine hearing application [80].

Figure 18:
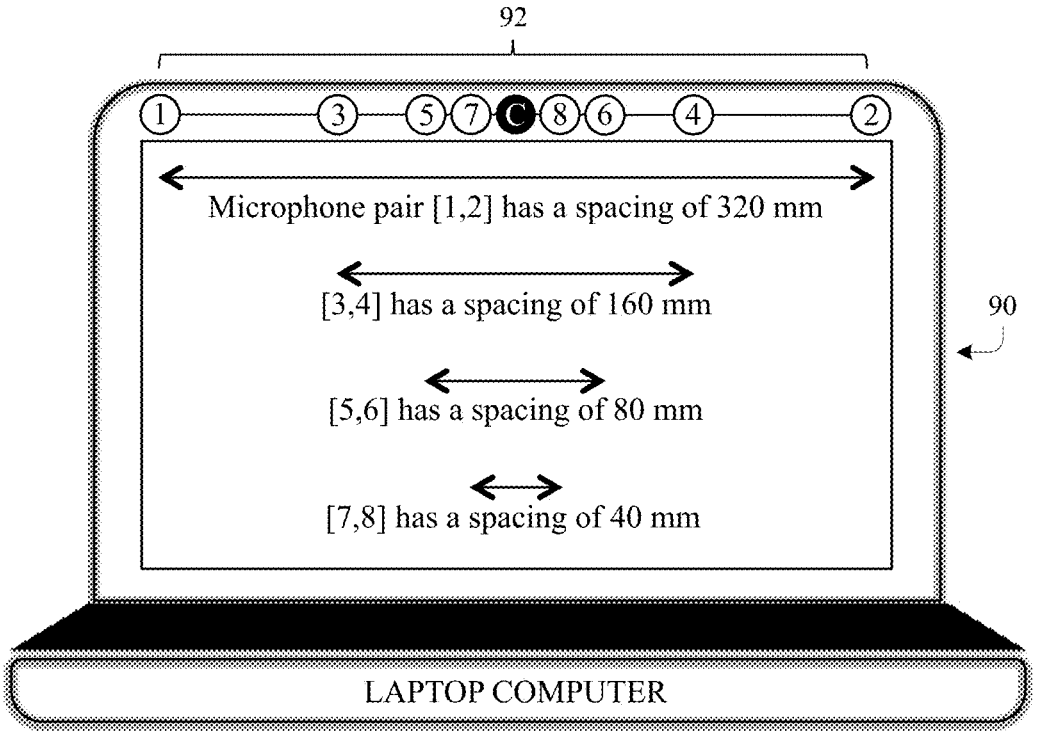
FIG. 18 (same as FIG. 10 in the original specification) is a depiction of a specialized computer incorporating microphone pairs for STTC processing.

FIG. 18 shows a physical realization of a computer structured according to FIG. 17, in this case in the form of a laptop computer [90] having an array of eight microphones [92] integrated into an upper part of its casing as shown. The four pairs ([1, 2], [3, 4], [5, 6], [7, 8]) of microphones have respective distinct spacings of 320, 160, 80 and 40 mm, respectively.

Figure 19:
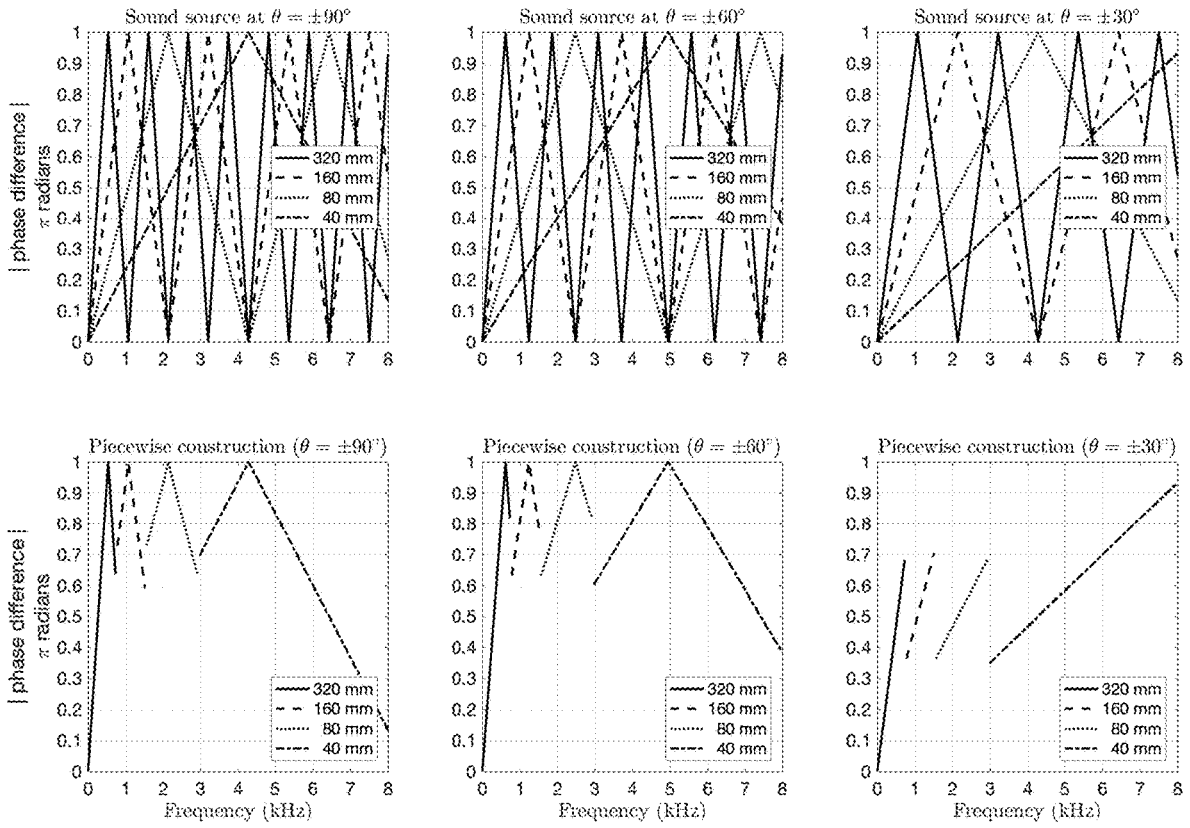
FIG. 19 (same as FIG. 11 in the original specification) is a plot of phase separations for microphone pairs of a specialized computer such as that of FIG. 18 (i.e., FIG. 10 in the original specification)

FIG. 19 is a set of plots of phase separations for the 8-microphone array, analogous to that of FIG. 5 for the 6-microphone array. The bottom panel illustrates a piecewise approach to creating the Global Ratio Mask $RM_G$ from the individual Ratio Masks for the four microphone pairs ([1, 2], [3, 4], [5, 6], [7, 8]). This is described in additional detail below.

Figure 20:
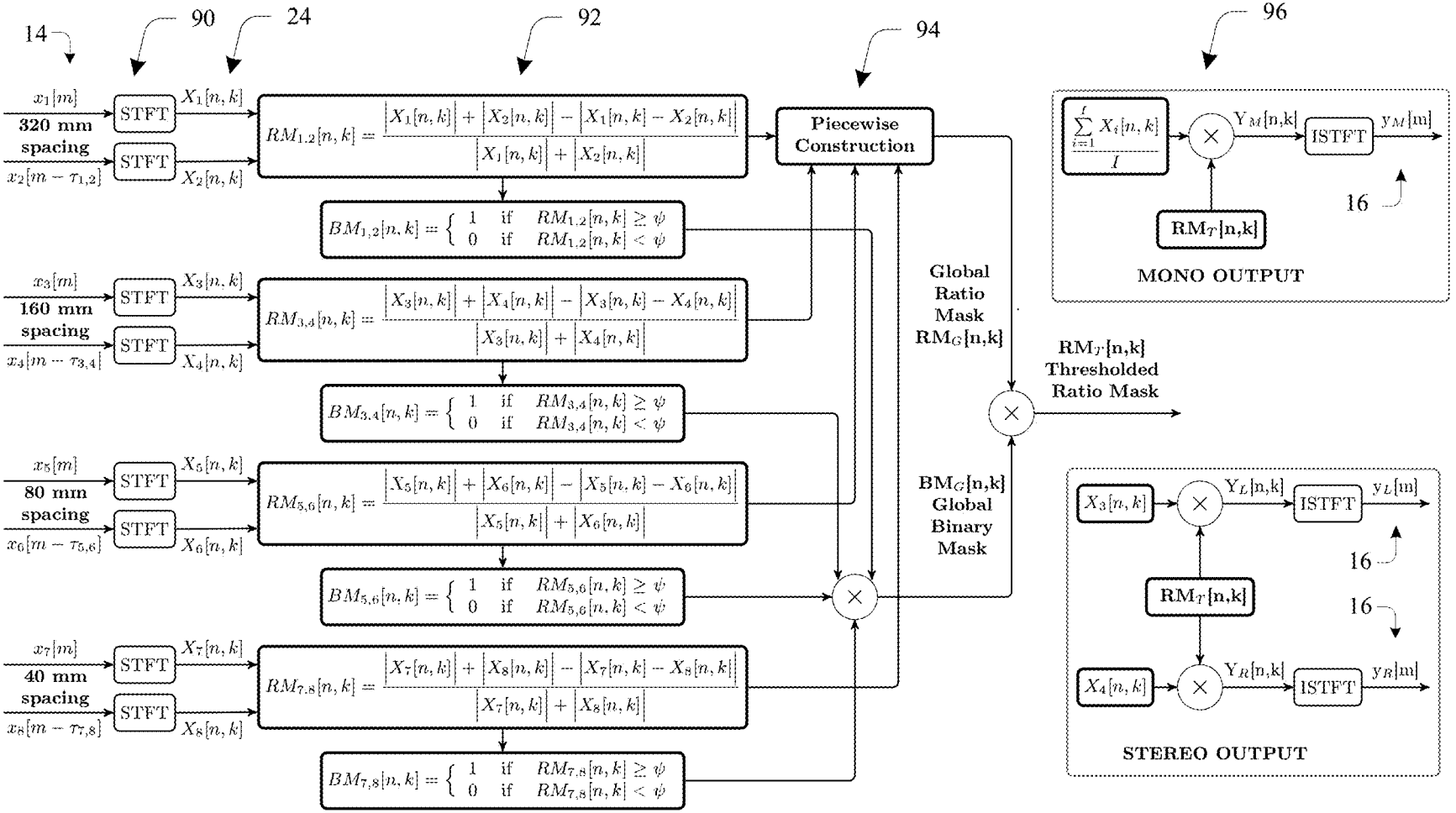
FIG. 20 (same as FIG. 12 in the original specification) is a block diagram of STTC processing for a computerized device such as that of FIG. 18 (i.e., FIG. 10 in the original specification)

FIG. 20 is a block diagram of the STTC processing [20-2] (FIG. 17), analogous to FIG. 6 described above. It includes the following distinct stages of calculations, similar to the processing of FIG. 6 except for use of four rather than three microphone pairs:

1. Short-Time Fourier Transform (STFT) processing [90], converts each microphone signal into frequency domain signal. 2. Ratio Mask (RM) and Binary Mask (BM) processing [92], applied to frequency domain signals of microphone pairs. 3. Global Ratio Mask ($RM_G$) and Thresholded Ratio Mask ($RM_T$) processing [94], uses ratio masks of all microphone pairs.

4. Output signal processing [96], uses the Thresholded Ratio Mask ($RM_T$) to scale/modify selected microphone signals to serve as output signal(s) [16].

In the STFT processing [90], individual STFT calculations [90] are the same as above. Two additional STFTs are calculated for the 4th microphone pair (7,8). In the RM processing [92], a fourth $RM_{7,8}$ is calculated for the fourth microphone pair:

$$RM_{1,2}[n,k]=\frac{|X_1[n,k]|+|X_2[n,k]|-|X_1[n,k]-X_2[n,k]|}{|X_1[n,k]|+|X_2[n,k]|} \tag{41a}$$

-continued $$RM_{3,4}[n,k]=\frac{|X_3[n,k]|+|X_4[n,k]|-|X_3[n,k]-X_4[n,k]|}{|X_3[n,k]|+|X_4[n,k]|} \tag{41b}$$

$$RM_{5,6}[n,k]=\frac{|X_5[n,k]|+|X_6[n,k]|-|X_5[n,k]-X_6[n,k]|}{|X_5[n,k]|+|X_6[n,k]|} \tag{41c}$$

$$RM_{7,8}[n,k]=\frac{|X_7[n,k]|+|X_8[n,k]|-|X_7[n,k]-X_8[n,k]|}{|X_7[n,k]|+|X_8[n,k]|} \tag{41d}$$

Also, as shown in the bottom panel of FIG. 19, piecewise construction of the global ratio mask $RM_G$ uses the four RMs as follows (using Fs=50 kHz and F=1024 for the examples herein):

$$RM_G[n,1{:}16]=RM_{1,2}[n,1{:}16]\ (\approx 0\rightarrow 750\text{ Hz})$$

$$RM_G[n,17{:}32]=RM_{3,4}[n,17{:}32]\ (\approx 750\rightarrow 1500\text{ Hz})$$

$$RM_G[n,33{:}61]=RM_{5,6}[n,33{:}61]\ (\approx 1500\rightarrow 3000\text{ Hz})$$

$$RM_G\left[n,62{:}\frac{F}{2}\right]=RM_{7,8}\left[n,62{:}\frac{F}{2}\right]\left(\approx 3000\rightarrow\frac{F_S}{2}\text{ Hz}\right)$$

Similarly, the pairwise BM calculations include calculation of a fourth Binary Mask, $BM_{7,8}$, for the fourth microphone pair [7, 8]:

$$BM_{1,2}[n,k]=\begin{cases}1 & \text{if } RM_{1,2}[n,k]\geq\psi\\ 0 & \text{if } RM_{1,2}[n,k]<\psi\end{cases} \tag{42a}$$

$$BM_{3,4}[n,k]=\begin{cases}1 & \text{if } RM_{3,4}[n,k]\geq\psi\\ 0 & \text{if } RM_{3,4}[n,k]<\psi\end{cases} \tag{42b}$$

$$BM_{5,6}[n,k]=\begin{cases}1 & \text{if } RM_{5,6}[n,k]\geq\psi\\ 0 & \text{if } RM_{5,6}[n,k]<\psi\end{cases} \tag{42c}$$

$$BM_{7,8}[n,k]=\begin{cases}1 & \text{if } RM_{7,8}[n,k]\geq\psi\\ 0 & \text{if } RM_{7,8}[n,k]<\psi\end{cases} \tag{42d}$$

And the Global Binary Mask $BM_G$ uses all four BMs:

$$BM_G[n,k]=BM_{1,2}[n,k]\times BM_{3,4}[n,k]\times BM_{5,6}[n,k]\times BM_{7,8}[n,k] \tag{43}$$

Figure 21:
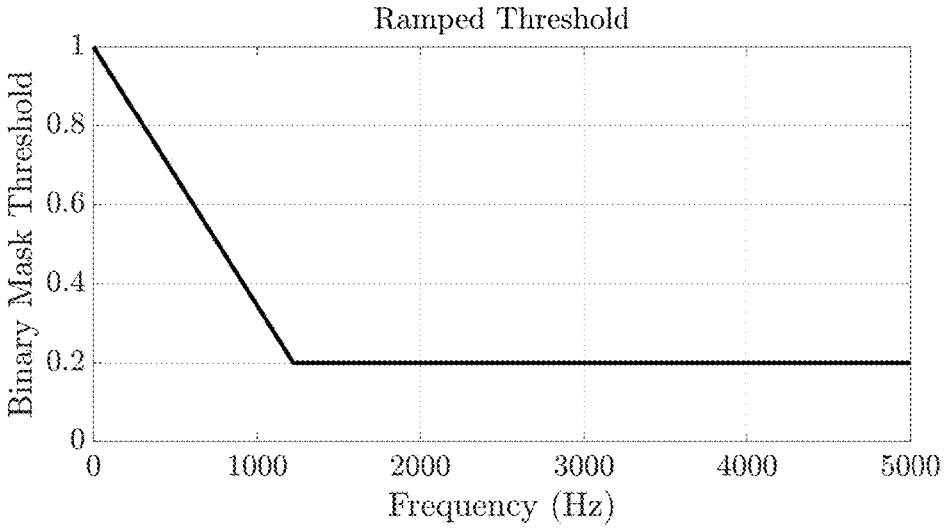
FIG. 21 (same as FIG. 13 in the original specification) is a plot for an alternative ramped threshold used in STTC processing.

FIG. 21 shows the less aggressively ramped threshold used for the BM calculations. For frequencies below 1250 Hz, the threshold ramps lin-early.

For the Output Signal Reconstruction [96], both stereo and mono alternatives are possible. These are generally similar to those of FIG. 6, except that the stereo version filters the signals from the third microphone pair (3,4). The mono version combines the outputs of all eight microphone signals:

$$X_M[n,k]=\frac{\sum_{i=1}^{I}X_i[n,k]}{I} \tag{44}$$

$$Y_M[n,k]=RM_T[n,k]\times X_M[n,k] \tag{45}$$

Alternative STTC HCI Processing [52] with Phase Difference Normalization.

Pairwise ratio masks RM, one for each microphone spacing (320, 160, 80 and 40 mm) can also be calculated as follows, using the Phase Difference Normalization Vectors (PDNV) described in ¶0065-0068; there is a unique RM for each pair of microphones ([1,2], [3,4], [5,6], [7,8]):

$$RM_{1,2}[n,k]=\frac{|X_1[n,k]|+|X_2[n,k]|-\Gamma_{[1,2]}[k]|X_1[n,k]-X_2[n,k]|}{|X_1[n,k]|+|X_2[n,k]|} \quad (46a)$$

$$RM_{3,4}[n,k]=\frac{|X_3[n,k]|+|X_4[n,k]|-\Gamma_{[3,4]}[k]|X_3[n,k]-X_4[n,k]|}{|X_3[n,k]|+|X_4[n,k]|} \quad (46b)$$

$$RM_{5,6}[n,k]=\frac{|X_5[n,k]|+|X_6[n,k]|-\Gamma_{[5,6]}[k]|X_5[n,k]-X_6[n,k]|}{|X_5[n,k]|+|X_6[n,k]|} \quad (46c)$$

$$RM_{7,8}[n,k]=\frac{|X_7[n,k]|+|X_8[n,k]|-\Gamma_{[7,8]}[k]|X_7[n,k]-X_8[n,k]|}{|X_7[n,k]|+|X_8[n,k]|} \quad (46d)$$

A pairwise Phase Difference Normalization Vector (PDNV) Γ[k], which scales the respective pairwise Noise ($\hat{N}$) estimate, can be pre-computed for each microphone pair spacing:

$$\Gamma_{[1,2]}[k]=\begin{cases}\frac{1}{\mathcal{P}_{[1,2]}[k]}=\left(\left|\angle e^{j2\pi w_k\beta\frac{d_{1,2}}{\lambda}\sin(\theta_{max})}\right|\right)^{-1}, & \text{if } \omega_k\le 500\text{ Hz}\\ 1, & \text{if } \omega_k>500\text{ Hz}\end{cases} \quad (47a)$$

$$\Gamma_{[3,4]}[k]=\begin{cases}\frac{1}{\mathcal{P}_{[3,4]}[k]}=\left(\left|\angle e^{j2\pi w_k\beta\frac{d_{3,4}}{\lambda}\sin(\theta_{max})}\right|\right)^{-1}, & \text{if } \omega_k\le 1000\text{ Hz}\\ 1, & \text{if } \omega_k>1000\text{ Hz}\end{cases} \quad (47b)$$

$$\Gamma_{[5,6]}[k]=\begin{cases}\frac{1}{\mathcal{P}_{[5,6]}[k]}=\left(\left|\angle e^{j2\pi w_k\beta\frac{d_{5,6}}{\lambda}\sin(\theta_{max})}\right|\right)^{-1}, & \text{if } \omega_k\le 2000\text{ Hz}\\ 1, & \text{if } \omega_k>2000\text{ Hz}\end{cases} \quad (47c)$$

$$\Gamma_{[7,8]}[k]=\begin{cases}\frac{1}{\mathcal{P}_{[7,8]}[k]}=\left(\left|\angle e^{j2\pi w_k\beta\frac{d_{7,8}}{\lambda}\sin(\theta_{max})}\right|\right)^{-1}, & \text{if } \omega_k\le 4000\text{ Hz}\\ 1, & \text{if } \omega_k>4000\text{ Hz}\end{cases} \quad (47d)$$

Figure 22:
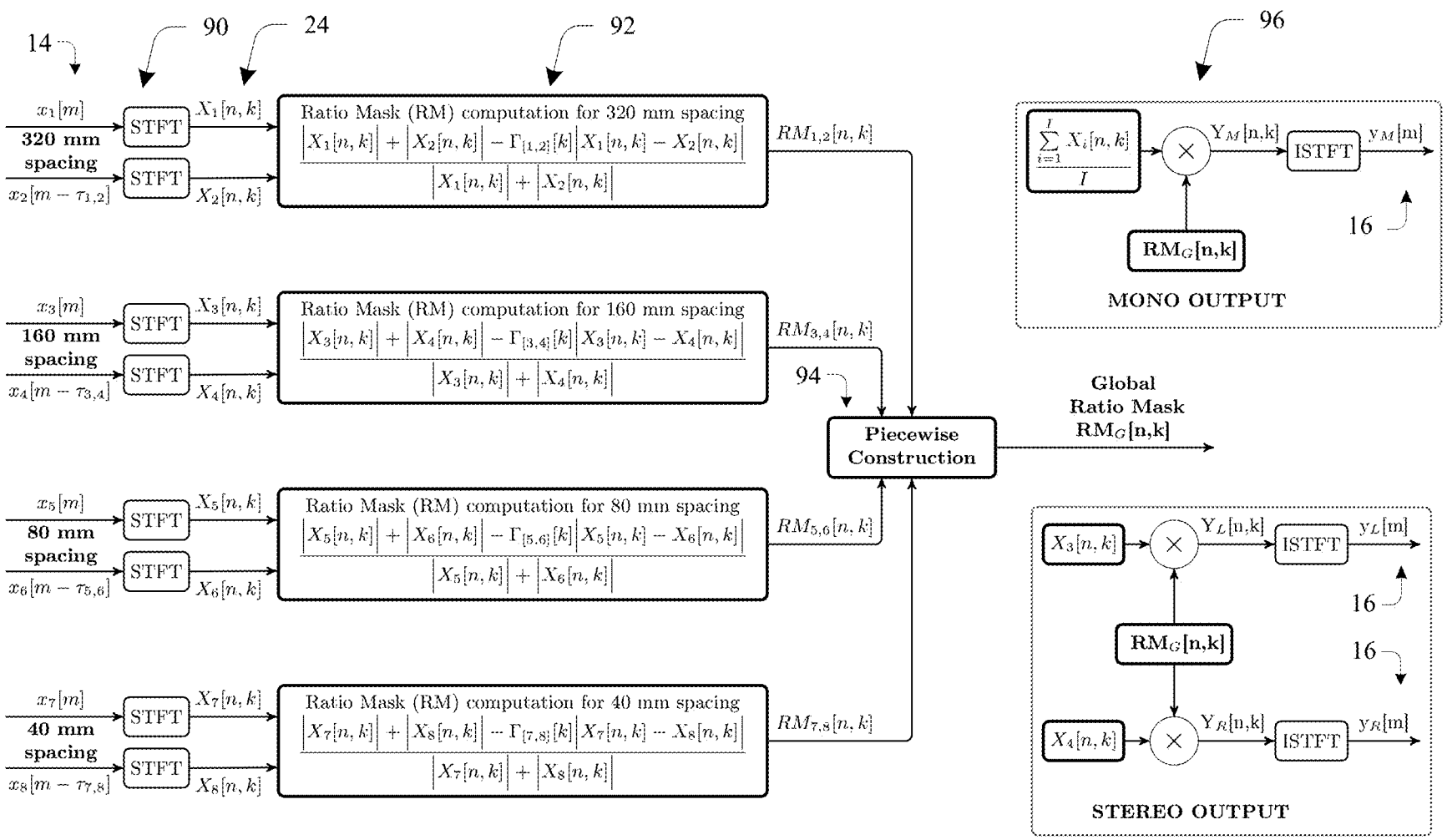
FIG. 22 is a block diagram of alternative STTC processing for a computerized device such as that of FIG. 18 (i.e., FIG. 10 in the original specification)

Below a pre-determined frequency cutoff, Γ[k] is inversely proportional to the discrete-frequency wrapped absolute phase difference $\mathcal{P}$ (see equation 27) at a maximum possible angular separation of $\theta_{max}=\pi/2$ radians. Although Γ[k] can be equivalent to the inverse of $\mathcal{P}$ across all discrete frequencies $w_k$, here Γ[k] is set to unity at and above a pre-determined frequency cutoff (see equation 47). This alternative processing, for the Human-Computer Interface (HCI) shown in FIG. 18, is illustrated in the block diagram in FIG. 22 (compare FIGS. 20 and 22).

Absolute phase differences for the four microphone spacings (320, 180, 80 and 40 mm) and three DOA angles (±30, ±60, ±90) are plotted in the top row of FIG. 19. There is an interaction between frequency, microphone spacing and DOA angle (θ) that yields wrapped [π, π] absolute phase differences of zero at specific frequencies. Where the phase difference is at or near zero, the target cancellation approach is ineffective, as the interfering sound sources are cancelled at these frequencies and thereby are erroneously included in the frequency-domain signal estimate ($\hat{S}=\hat{M}-\hat{N}$). Multiple microphone pairs are used to overcome this null phase difference problem and thereby improve performance. This is further illustrated in FIG. 23 for a mixture of three concurrent talkers (compare FIGS. 19, 22 and 23).

Figure 23:
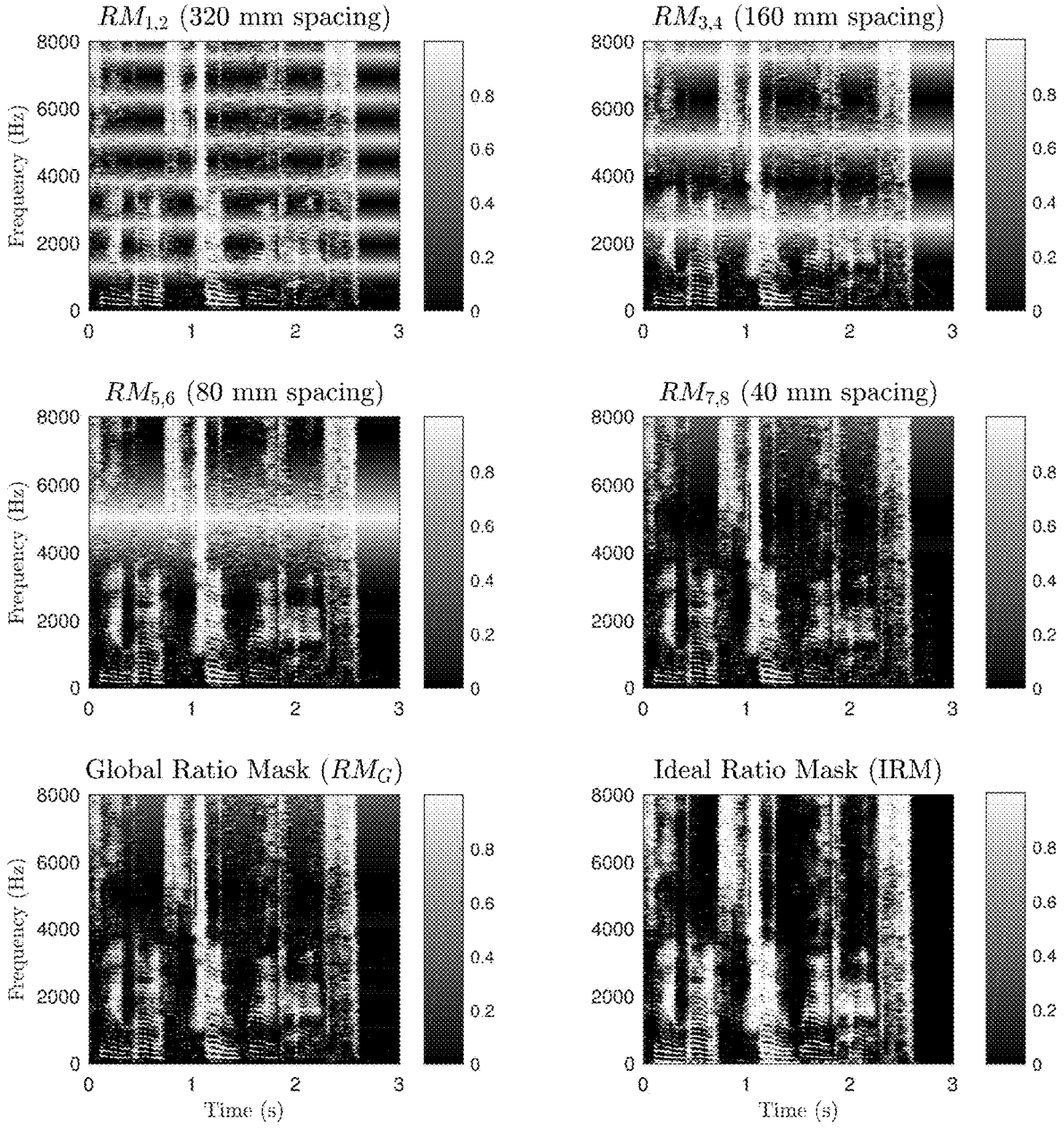
FIG. 23 is a demonstration figure with example Time-Frequency (T-F) masks for a mixture of three concurrent talkers.

Example Time-Frequency (T-F) masks for a mixture of three talkers are shown in FIG. 23. The three concurrent talkers were at −60°, 0° and +60°, with all three talkers at equal loudness. The target talker was "straight ahead" at 0° and the two interfering talkers were to the left and right at ±60°. The Ratio Masks from the four microphone pairs ([1,2], [3,4], [5,6] and [7,8]) are shown in the first four panels. For each of these Ratio Masks, there are frequencies at which there is no phase difference between target and interferer, resulting in bands of T-F tiles with (incorrect) values of (or near) "1" (see horizontal whitebands in the first three panels). However, multiple T-F masks from the multiple microphone pairs can be interfaced to yield a Global Ratio Mask $RM_G$ (bottom Left panel) that is similar in appearance to the Ideal Ratio Mask (IRM) computed using "oracle knowledge" of the signal and noise components in the mixture. $RM_G$ is an effective time-varying filter, with a vector of frequency channel weights for every analysis frame.

The processing computes multiple pairwise ratio masks for multiple microphone spacings (e.g., 320, 160, 80 and 40 mm). Each of the four Ratio Masks ($RM_{1,2}$, $RM_{3,4}$, $RM_{5,6}$ $RM_{7,8}$) has frequency bands where the T-F tiles are being overestimated (see horizontal white bands with values of "1" in FIG. 23). However, the multiple pairwise ratio masks can be interfaced (FIGS. 19 and 22) to compute a chimeric (i.e., composite) T-F mask which can look similar to the Ideal Ratio Mask (IRM) (see FIG. 23). Only the signals from the microphones (see FIG. 22) were used as input, whereas the IRM, which has a transfer function equivalent to a time-varying Weiner filter, is granted access to the component Signal (S) and Noise (N) terms:

$$IRM(t,f)=\frac{S^2(t,f)}{S^2(t,f)+N^2(t,f)} \quad (48)$$

where $S^2(t, f)$ and $N^2(t, f)$, are the signal (i.e., target speech) energy and noise energy, respectively; i.e., the Ideal Ratio Mask has "oracle knowledge" of the signal and noise components. The STTC ALD is capable of computing a T-F mask, in real-time, that is similar to the IRM (see FIG. 23), and does so without requiring any information about the noise source(s).

Alternative Embodiments of STTC Human-Computer Interface (HCI).

Alternative embodiments of an STTC Human-Computer Interface (HCI) could use a variety of microphone array configurations and alternative processing. For example, a "broadside" and/or "endfire" array of microphone pairs could be incorporated into any number of locations and surfaces in the dashboard or cockpit of a vehicle, or in the housing of a smartphone or digital home assistant device. Furthermore, as described in ¶0051 herein and in the original specification, τ sample shifts can be used to steer the "look" direction of the microphone array. Hence, any number of microphone orientations, relative to the location of the target talker, can be used for an HCI application embodiment of the invention. For example, the alternative processing for the third embodiment of the STTC ALD, described in paragraphs ¶0083-0093 and illustrated in FIGS. 15 and 16, could be adapted for use in an HCI application, with the microphones in an "endfire" array configuration relative to the target talker, and the STTC processing steered 90° towards the target talker (or towards any designated "look" direction) by τ sample shifts; see ¶0051 herein and in the original specification.

Embodiment in a 2-Microphone Binaural Hearing Aid.

Although the devices described thus far have leveraged multiple microphone pairs to compute an effective time-varying filter that can suppress non-stationary sound sources, the approach could also be used in binaural hearing aids using only two near-ear microphones [44], as shown in FIG. 4. While the overall performance would not be comparable to that of the six microphone implementation, a two microphone implementation would indeed still provide a speech intelligibility benefit, albeit only for a "straight ahead" look direction of 0°; i.e., the "look" direction would not be steerable. Because much of the processing is the same or similar as that of the 6-microphone assistive listening device described earlier, the description below is limited to highlighting the key differences when using only one pair of binaural in-ear microphones.

Figure 24:
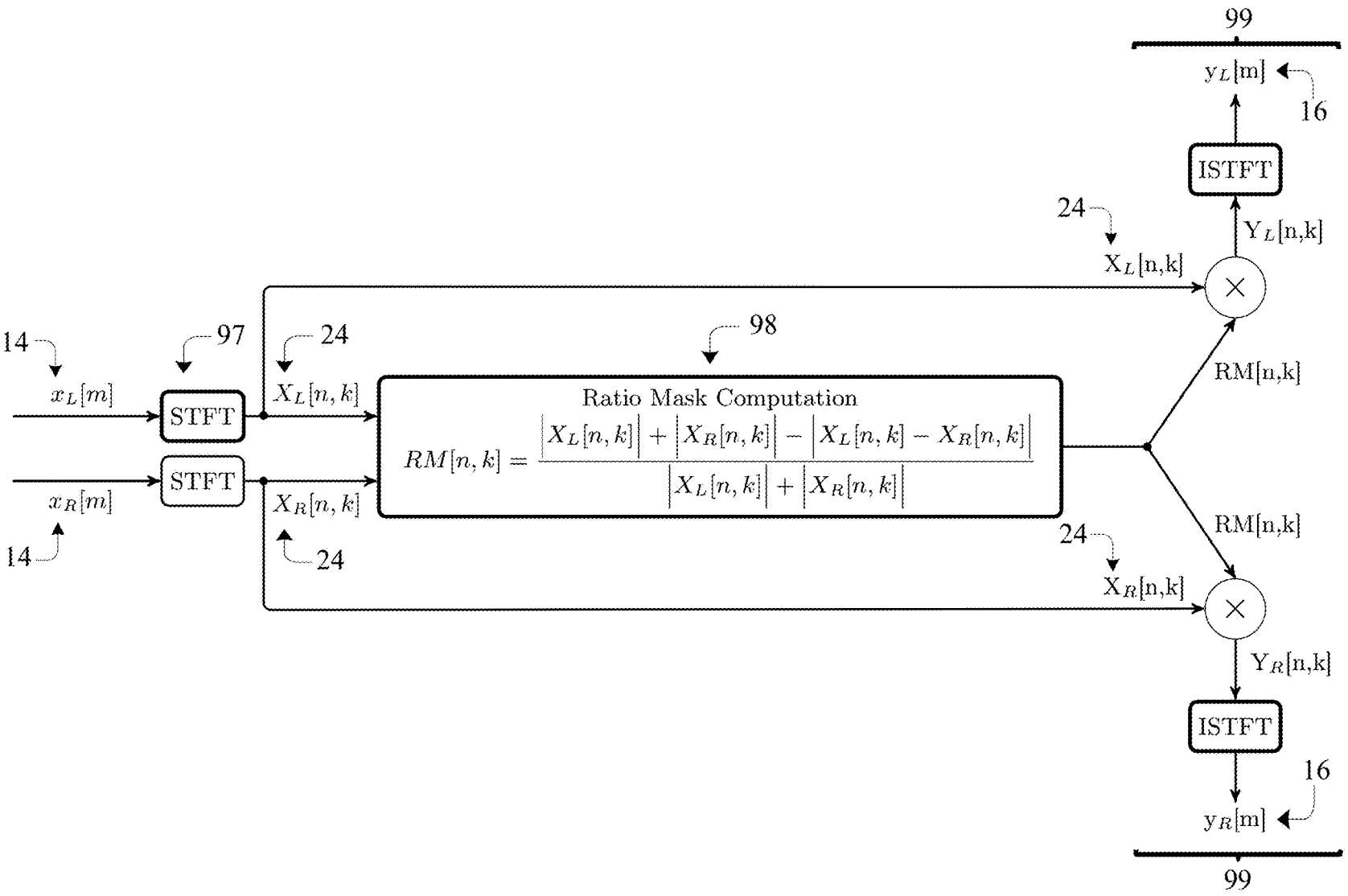
FIG. 24 (same as FIG. 14 in the original specification) is a block diagram of STTC processing for a binaural hearing aid.
Figure 25:
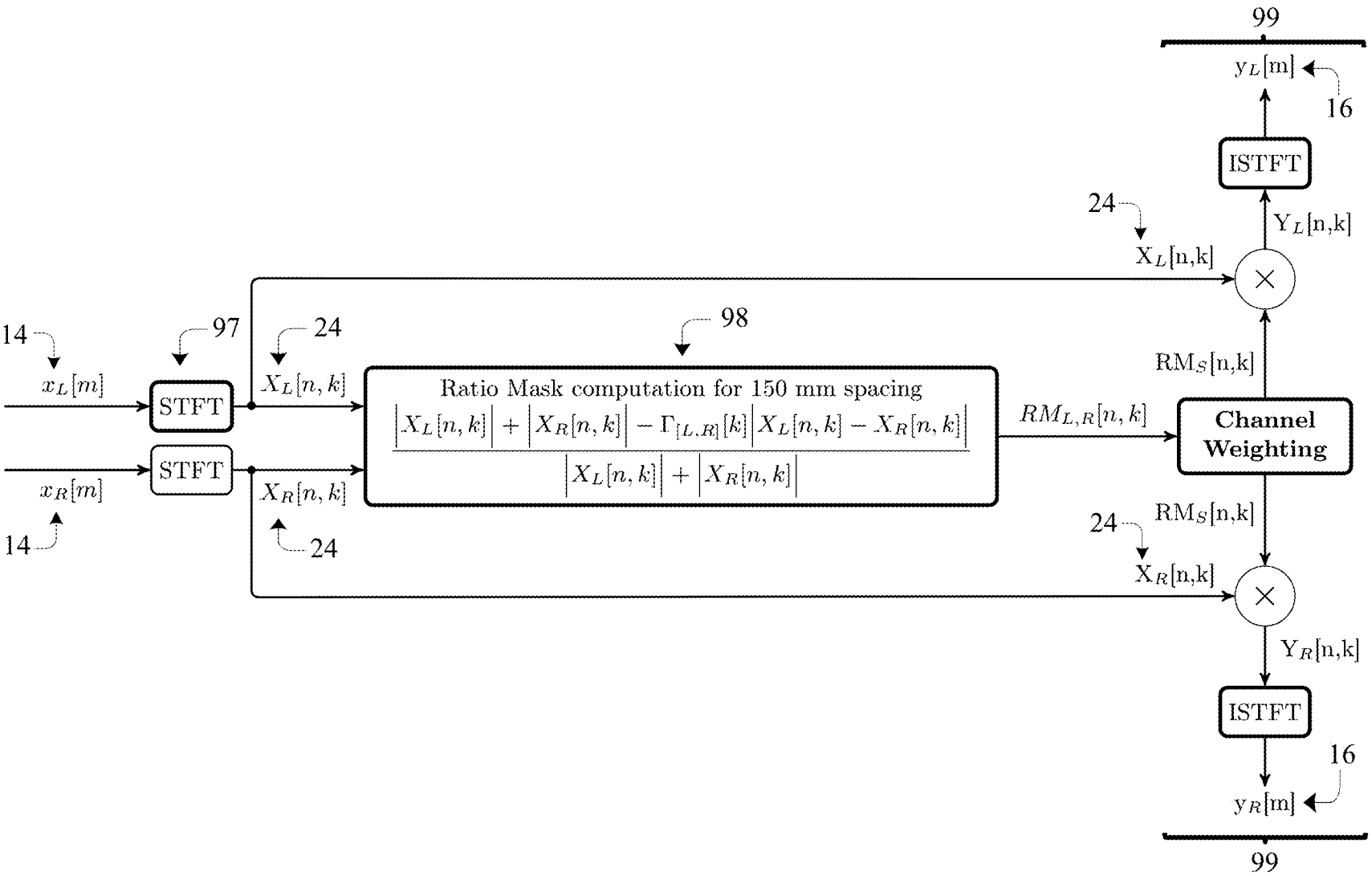
FIG. 25 is a block diagram of alternative STTC processing for a binaural hearing aid.

FIG. 24 is a block diagram of minimalist STTC processing for a single pair of binaural in-ear (or near-ear) microphones [44]. It includes the following distinct stages of calculations, similar to the processing of FIG. 6 except for the use of only one, rather than three, microphone pairs: 1. Short-Time Fourier Transform (STFT) processing [97], converts each microphone signal into frequency domain signal. 2. Ratio Mask (RM) processing [98], applied to frequency domain signals of the microphone pair. 3. Output signal processing [99], uses the ratio mask RM to scale/modify the binaural input signals to serve as binaural output signal(s) [16].

The STTC processing [98] would use only the signals from the binaural microphones, the Left and Right STFTs $X_L[n, k]$ and $X_R[n,k]$ [24], to compute a Ratio Mask (RM):

$$RM[n,k] = \frac{|X_L[n,k]| + |X_R[n,k]| - |X_L[n,k] - X_R[n,k]|}{|X_L[n,k]| + |X_R[n,k]|} \tag{49}$$

If there is only one pair of microphones, and therefore only one Ratio Mask (RM) is computed, then the Global Ratio Mask ($RM_G$) and the single Ratio Mask (RM) are equivalent; i.e., $RM_G[n, k]=RM[n, k]$.

For the output signal reconstruction [99], the $RM_G[n, k]$ T-F mask (i.e., time-varying filter) can be used to filter the signals from the Left and Right near-ear microphones [44]:

$$Y_L[n,k]=RM_G[n,k]\times X[n,k]\,Y_R[n,k]=RM_G[n,k]\times X_R[n,k] \tag{50}$$

Synthesis of a stereo output ($y_L[m]$ and $y_R[m]$) estimate of the target speech signal consists of taking the Inverse Short Time Fourier Transforms (ISTFTs) of $Y_L[n, k]$ and $Y_R[n, k]$ and using the overlap-add method of reconstruction. The minimalist processing described here would provide a speech intelligibility benefit, for a targer talker "straight ahead" at 0°, while still preserving binaural cues. Alternative processing might include using a Thresholded Ratio Mask ($RM_T$), as described in the previous sections, for computing the outputs $Y_L$ and $Y_R$.

A Binary Mask BM[n, k] may also be computed using a thresholding function, with threshold value ψ, which may be set to a fixed value of ψ=0.2 for example:

$$BM[n,k] = \begin{cases} 1 & \text{if } RM[n,k] \geq \psi \\ 0 & \text{if } RM[n,k] < \psi \end{cases} \tag{51}$$

When using only one pair of microphones, the Thresholded Ratio Mask ($RM_T$) is the product of the Ratio Mask and Binary Mask:

$$RM_T[n,k]=RM[n,k]\times BM[n,k] \tag{52}$$

For this alternative processing for the output signal reconstruction [99], when using only one pair of microphones, the $RM_T[n, k]$ T-F mask (i.e., time-varying filter) can be used to filter the signals from the Left and Right near-ear microphones [44]:

$$Y_L[n,k]=RM_T[n,k]\times X_L[n,k]\,Y_R[n,k]=RM_T[n,k]\times X_R[n,k] \tag{53}$$

Alternative Processing and Alternative Embodiments of an STTC Binaural Hearing Aid.

Alternative processing, which now incorporates the Phase Difference Normalization Vector (PDNV) computation described earlier in ¶0065-0068, is illustrated in the following pages and in FIGS. 25-30, which detail variations of an STTC binaural hearing aid.

Alternative Two-Microphone Binaural Processing with Phase Difference Normalization A pairwise "Left,Right" Ratio Mask $RM_{L,R}$ can also be calculated as follows, using the signals from a "Left, Right" ([L,R]) pair of binaural microphones:

$$RM_{L,R}[n,k] = \frac{|X_L[n,k]| + |X_R[n,k]| - \Gamma_{[L,R]}[k]|X_L[n,k] - X_R[n,k]|}{|X_L[n,k]| + |X_R[n,k]|} \tag{54}$$

A pairwise Phase Difference Normalization Vector (PDNV) $\Gamma_{L,R}[k]$, which scales the pairwise Noise ($\hat{N}$) estimate, can be pre-computed for the [L,R] microphone pair spacing:

$$\Gamma_{[L,R]}[k] = \begin{cases} \dfrac{1}{\mathcal{P}_{[L,R]}[k]} = \left(\left|{}_{L}e^{j2\pi\omega_k\beta_{L,R}\frac{d_{L,R}}{\lambda}\sin(\theta_{max})}\right|\right)^{-1}, & \text{if } \omega_k \leq F_c \text{ Hz} \\ 1, & \text{if } \omega_k > F_c \text{ Hz} \end{cases} \tag{55}$$

Here we assume that the target talker is "straight ahead" at 0°; i.e., directly in front of the ALD user. Hence, the "Left,Right" processing does not need to be steered via τ sample shifts and $\beta_{L,R}$ is given the default unity value (i.e., $\beta_{L,R}=1$). Note that in order to compute $\Gamma_{[L,R]}[k]$, the distance in meters between the two microphones, $d_{L,R}$, needs to be either known or estimated. Hence, this $d_{L,R}$ value may need to be determined and/or tuned for users, since these are binaural microphones and there is a range of human head widths. As a default value, we can assume that $d_{L,R}$=150 mm, which is the width of the average human head. Modifications might also have to be made to the computation of $\Gamma_{[L,R]}[k]$, shown in equation 55, to account for frequency-dependent ITD, ILD and interaural phase differences caused by head shadowing.

Below a pre-determined frequency cutoff $F_c$, the PDNV $\Gamma_{[L,R]}[k]$ is inversely proportional to the discrete-frequency wrapped absolute phase difference $\mathcal{P}$ (see equation 27) at a maximum possible angular separation of $\theta_{max}=\pi/2$ radians. Although the PDNV Γ[k] can be equivalent to the inverse of $\mathcal{P}$ across all discrete frequencies $w_k$, here Γ[k] is set to unity at and above a pre-determined frequency cutoff. This alternative processing, for two-microphone binaural processing with Phase Difference Normalization, is illustrated in the block diagram in FIG. 25 (compare FIGS. 24 and 25). An optional "Channel Weighting" post-processing step (see ¶0080-0081) smooths $RM_{L,R}[n, k]$ along the frequency axis to yield the Smoothed Ratio Mask $RM_S$, which can then be applied to the signals from the Left and Right ears (see FIG. 25).

Alternative Dual-Monaural STTC Processing with Binaural Microphone Pairs

A second embodiment in a binaural hearing aid would use a pair of near-ear microphones in each ear, and would adapt the pairwise processing to compute a Ratio Mask independently for the Left and Right ears, respectively. This is illustrated in the block diagram shown in FIG. 26, and for the ALD shown in FIG. 27.

Figure 27:
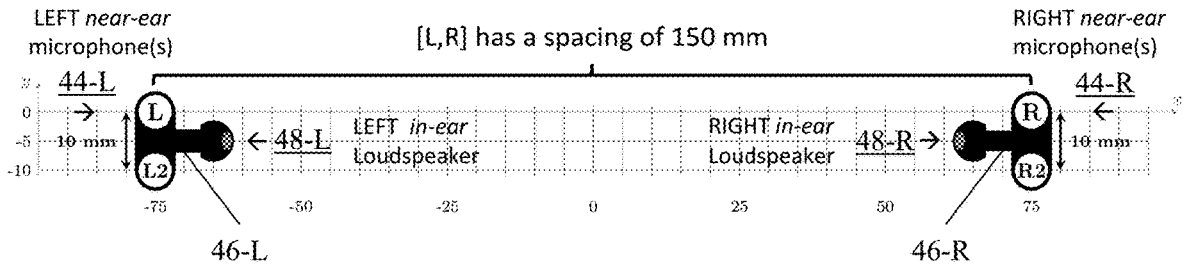
FIG. 27 is a depiction of a binaural hearing aid (i.e., ALD) incorporating two pairs of microphones for STTC processing.

FIG. 27 shows an example physical realization of an assistive listening device or ALD, specifically as a set of microphones and loudspeakers worn by a user. In this realization, the microphones are two pairs of two near-ear microphones [44-R], [44-L]. The near-ear microphones [44] are included in respective right and left earbuds [46-R], [46-L] along with corresponding in-ear loudspeakers [48-R], [48-L]. This is comparable to the binaural (i.e., left and right) earbuds described herein, and in the original specification, in ¶0021 and FIG. 4, albeit with a pair of in-ear microphones in both the Left ([L, L2]) and Right ([R, R2]) earbuds, respectively.

As described in ¶0051 herein and in the original specification, τ sample shifts can be used to steer the "look" direction of the microphone array. As shown on the far Left side of FIG. 26, τ sample shifts delay the signals from the anterior L and R microphones (See FIG. 27), relative to the posterior L2 and R2 microphones, before Time-Frequency analysis, so as to steer the "look" direction by 90°, towards a target talker in front of the ALD user. The τ sample shifts are computed for a given microphone spacing where $F_s$ is the sampling rate, $d_L$ and $d_R$ are the inter-microphone spacing in meters for the Left ([L, L2]) and Right ([R, R2]) side microphone pairs, λ is the speed of sound in meters per second and θ is the specified angular "look" direction in radians:

$$\tau_L = \left\lfloor f_s \times \frac{d_L}{\lambda}\sin(\theta)\right\rceil \quad \tau_R = \left\lfloor f_s \times \frac{d_R}{\lambda}\sin(\theta)\right\rceil \tag{56}$$

Figure 26:
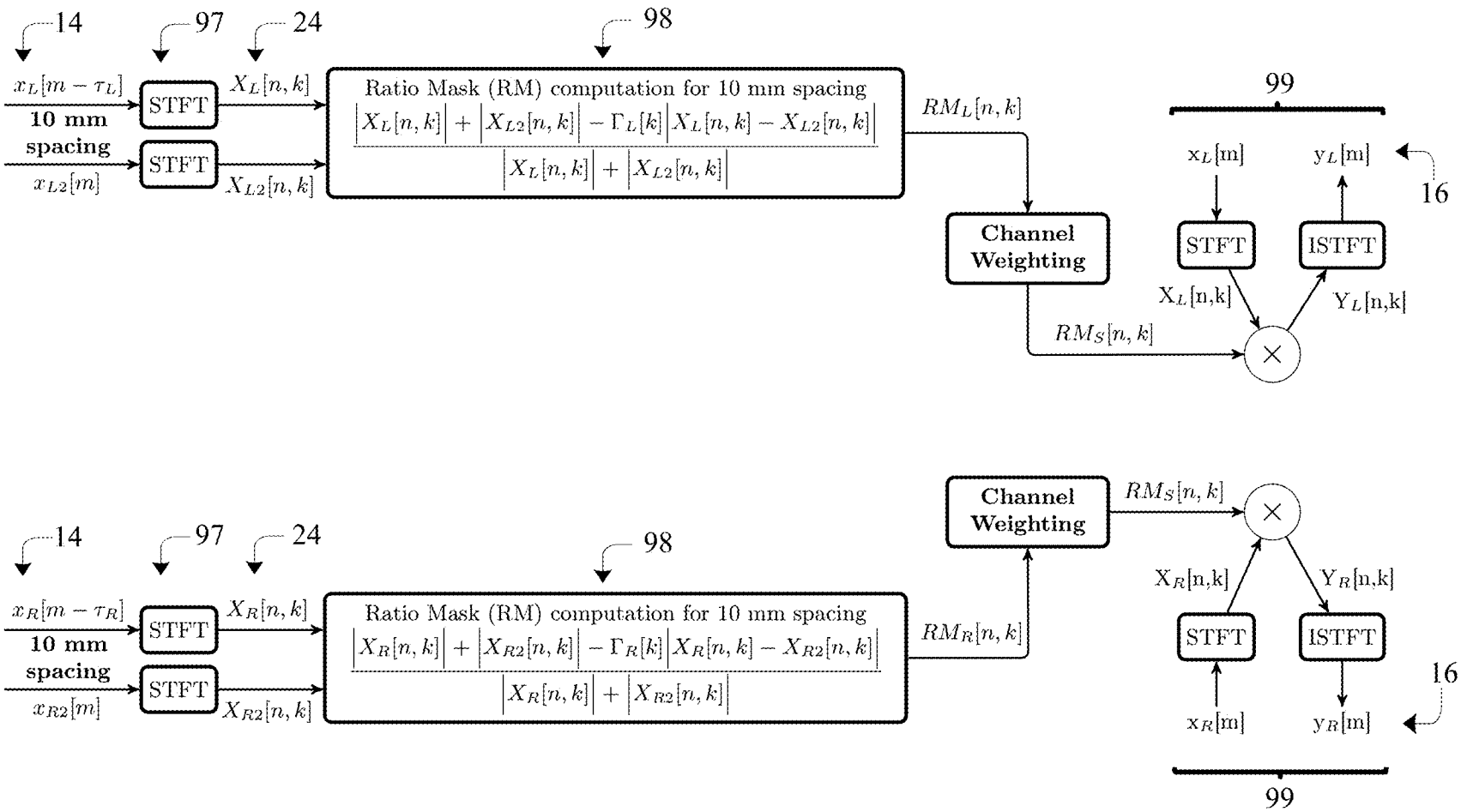
FIG. 26 is a block diagram of alternative STTC processing for a "dual monaural" binaural hearing aid.

Values of $$\theta = \frac{\pi}{2}$$

and d=10 mm (i.e., $d_L$=10 mm and $d_R$=10 mm) are used for the processing and array configuration illustrated in FIGS. 26 and 27. Because the "look" direction is steered 90° (i.e., $$\theta = \frac{\pi}{2}$$

radians), a value of β=2 is used for the scaling parameters $\beta_L$ and $\beta_R$ (i.e., $\beta_L$=2 and $\beta_R$=2) that are used to compute the $\Gamma_L$[k] and $\Gamma_R$[k] Phase Difference Normalization Vectors (PDNV) for the Left ([L,L2]) and Right ([R,R2]) microphone pairs, respectively.

Pairwise Left and Right ratio masks, $RM_L$ and $RM_R$, can be calculated as follows; i.e., there is a unique RM for the respective Left and Right microphone pairs ([L, L2], [R, R2]):

$$RM_L[n,k] = \frac{|X_L[n,k]| + |X_{L2}[n,k]| - \Gamma_L[k]|X_L[n,k] - X_{L2}[n,k]|}{|X_L[n,k]| + |X_{L2}[n,k]|} \tag{57a}$$

-continued $$RM_R[n,k] = \frac{|X_R[n,k]| + |X_{R2}[n,k]| - \Gamma_R[k]|X_R[n,k] - X_{R2}[n,k]|}{|X_R[n,k]| + |X_{R2}[n,k]|} \tag{57b}$$

Left and Right side pairwise Phase Difference Normalization Vectors (PDNV)$\Gamma_L$[k] and $\Gamma_R$[k], which scale the respective pairwise Noise ($\hat{N}$) estimates in equation 57, can be pre-computed for the $d_L$ and $d_R$ microphone pair spacings, which are 10 mm in the example illustrated in FIGS. 26 and 27:

$$\Gamma_L[k] = \begin{cases} \frac{1}{\mathcal{P}_L[k]} = \left(\left|{}_L e^{j2\pi\omega_k \beta_L \frac{d_L}{\lambda}\sin(\theta_{max})}\right|\right)^{-1} & \text{if } \omega_k \le F_c \text{ Hz} \\ 1, & \text{if } \omega_k > F_c \text{ Hz} \end{cases} \tag{58a}$$

$$\Gamma_R[k] = \begin{cases} \frac{1}{\mathcal{P}_R[k]} = \left(\left|{}_L e^{j2\pi\omega_k \beta_R \frac{d_R}{\lambda}\sin(\theta_{max})}\right|\right)^{-1} & \text{if } \omega_k \le F_c \text{ Hz} \\ 1, & \text{if } \omega_k > F_c \text{ Hz} \end{cases} \tag{58b}$$

Below a pre-determined frequency cutoff $F_c$, the pairwise PDNV Γ[k] is inversely proportional to the discrete-frequency wrapped absolute phase difference $\mathcal{P}$ (see equation 58) at a maximum possible angular separation of $$\theta_{max} = \frac{\pi}{2}$$

radians. Although the pairwise PDNV Γ[k] can be equivalent to the inverse of $\mathcal{P}$ across all discrete frequencies $w_k$, here Γ[k] is set to unity at and above a pre-determined frequency cutoff. This alternative processing is illustrated in the block diagram in FIG. 26. An optional "Channel Weighting" post-processing step (see ¶0080-0081) smooths $RM_{L,R}$[n, k] along the frequency axis to yield the Smoothed Ratio Mask $RM_S$, which can then be applied to the signals from the Left and Right ears (see FIG. 26).

Alternative STTC Binaural Hearing Aid with Phase Difference Normalization

A third example embodiment of a binaural hearing aid with STTC processing combines the first and second embodiments, with both binaural and "dual monaural" processing. The "piecewise construction" approach, described herein and in the original specification, is used to compute a Global Ratio Mask $RM_G$ from pairwise Ratio Masks (RM) computed with varied microphone spacings. This third example embodiment uses both a 150 mm spacing ([L, R]) and a 10 mm spacing ([L, L2] and [R, R2]), as illustrated in FIG. 27.

Figure 28:
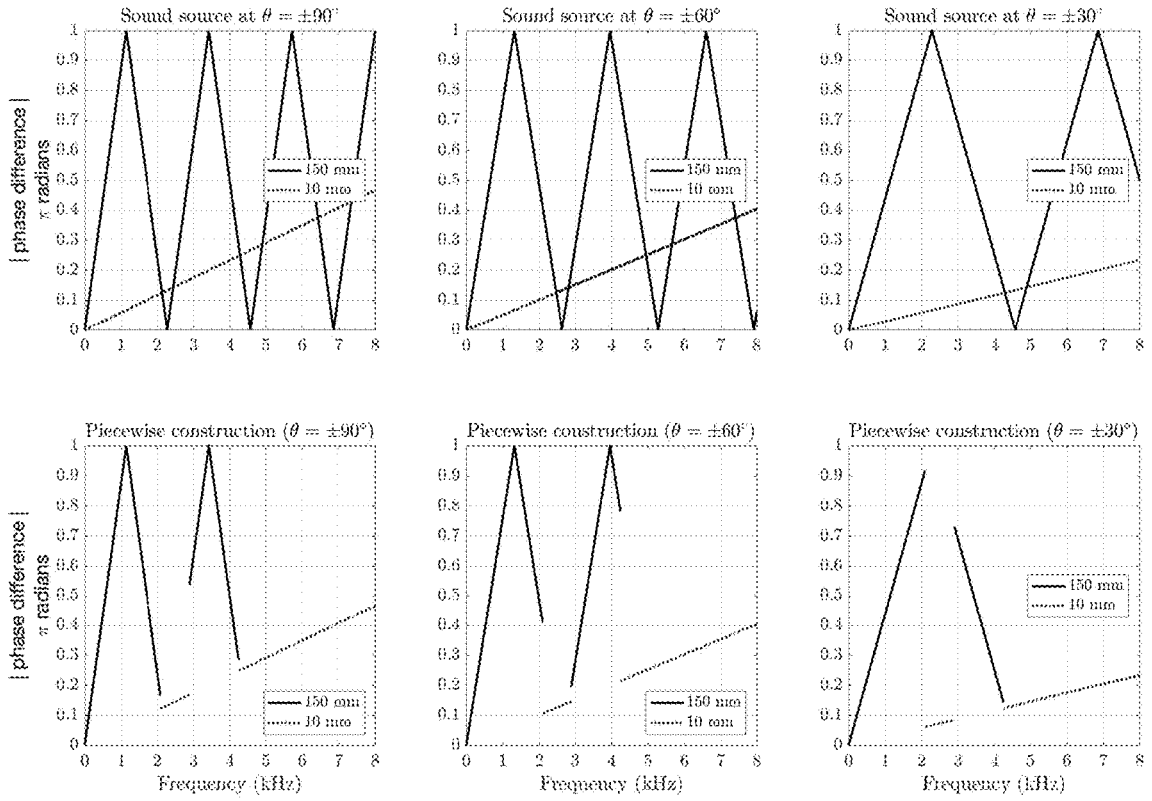
FIG. 28 is a third plot of phase separations, for microphone pairs of a binaural hearing aid such as that of FIG. 27.

Absolute phase differences for the two microphone spacings (150 and 10 mm) and three Direction of Arrival (DOA) angles (±30, ±60, ±90) are plotted in the top row of FIG. 28. There is an interaction between frequency, microphone spacing and Direction of Arrival angle (θ) that yields wrapped [π, π] absolute phase differences of zero at specific frequencies. Where the phase difference is at or near zero, the target cancellation approach is ineffective, as the interfering sound sources are cancelled at these frequencies and thereby are erroneously included in the frequency-domain signal estimate ($\hat{S}=\hat{M}-\hat{N}$). Multiple microphone pairs are used to overcome this null phase difference problem and thereby improve performance.

One disadvantage of using narrowly spaced microphones is that there isn't much phase difference for the STTC processing to work with, especially at low frequencies. Hence the approach taken with this third embodiment is to use the wider spacing of the binaural ([L,R]) microphone pair for the lower frequencies (<2 kHz), and to use the more narrowly spaced "dual monaural" ([L, L2] and [R, R2]) microphone pairs for the ≈2-3 kHz frequency range(s) where the binaural microphone pair suffers from null phase differences; this "piecewise construction" approach is illustrated in the bottom row of FIG. 28.

Figure 29:
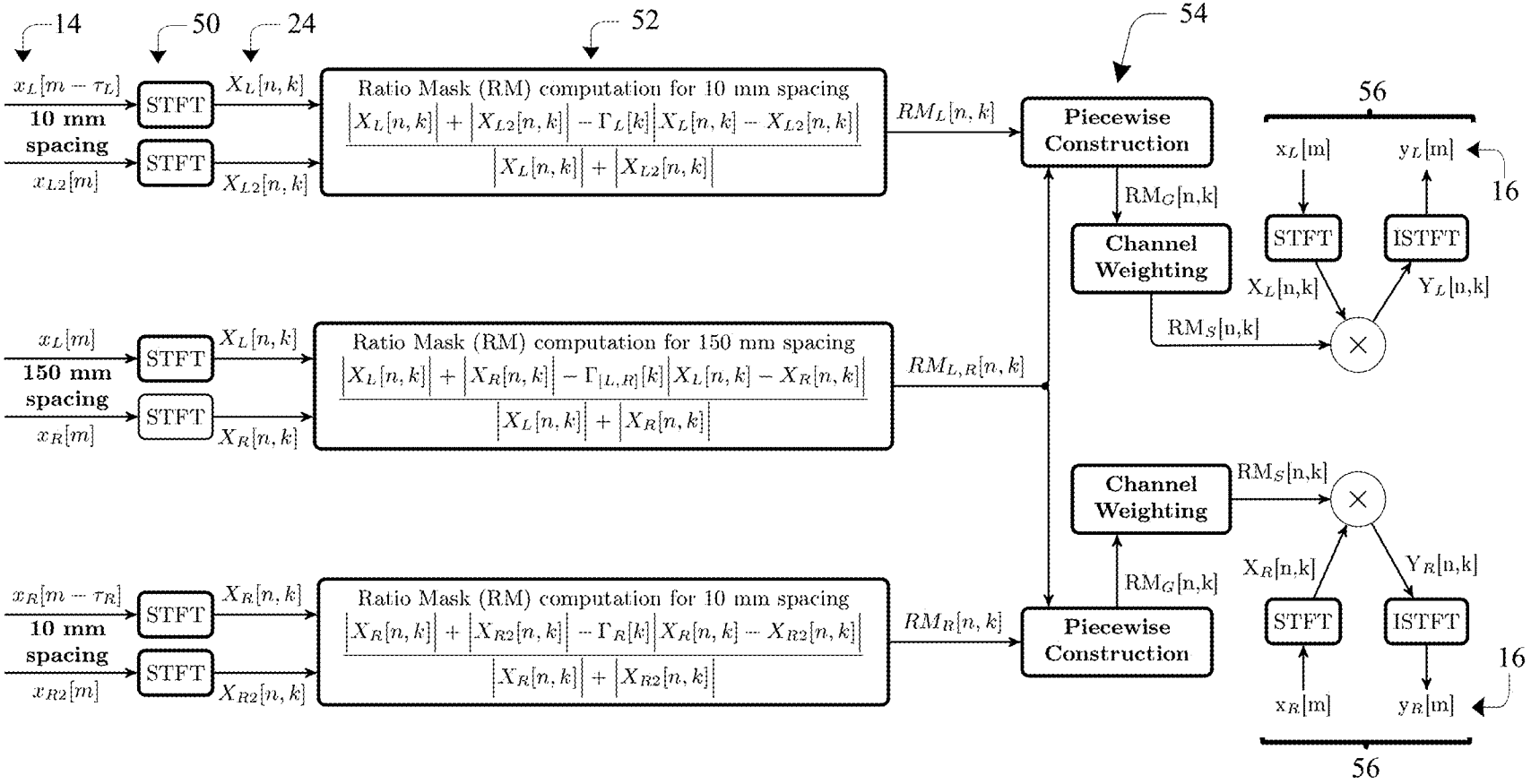
FIG. 29 is a block diagram of alternative STTC processing for a binaural hearing aid such as that of FIG. 27.
Figure 30:
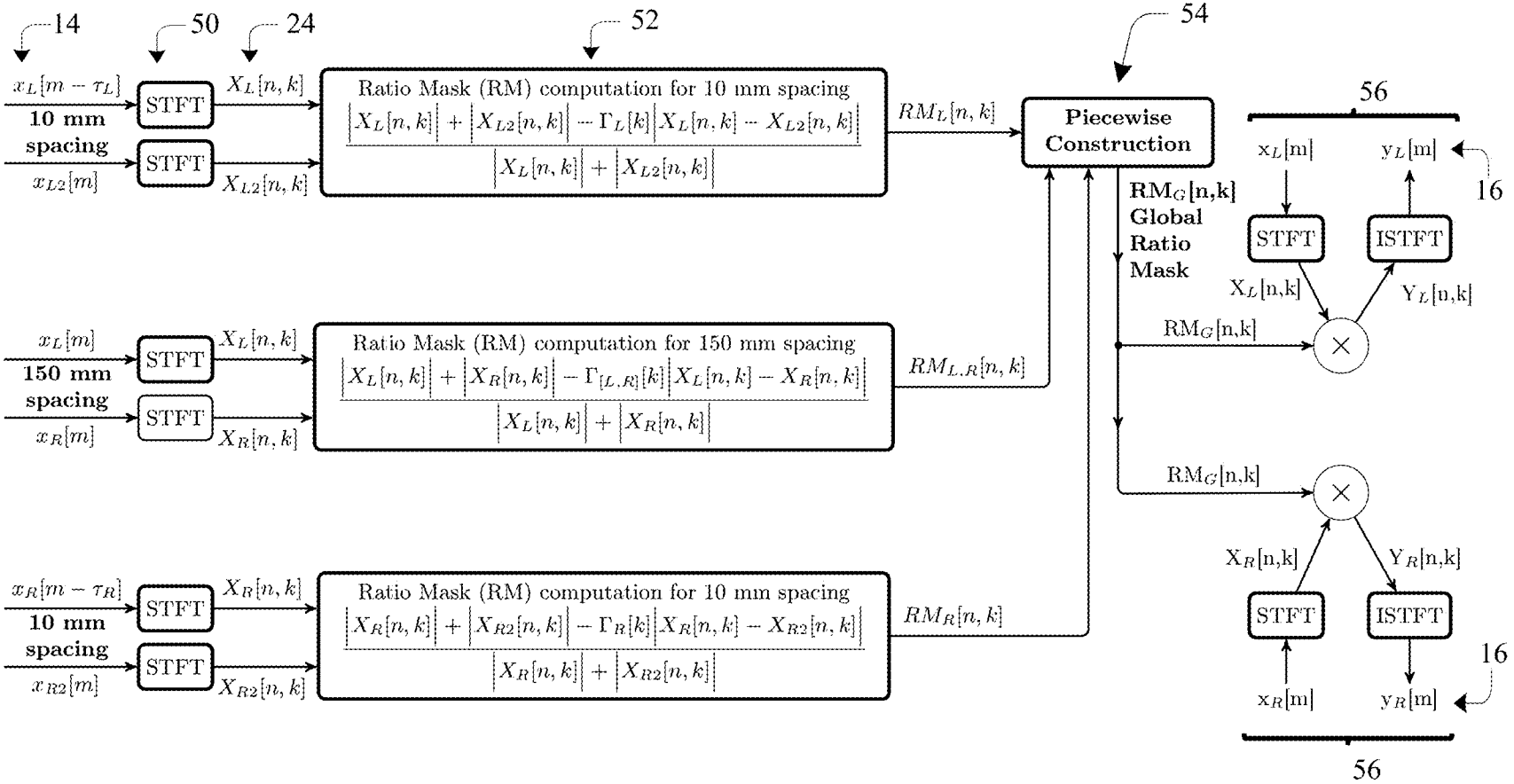
FIG. 30 is a block diagram of alternative STTC processing for a binaural hearing aid such as that of FIG. 27.

Block diagrams for this third example embodiment, of a binaural hearing aid with STTC processing, are shown in FIGS. 29 and 30; compare with the first "binaural" embodiment (FIGS. 24 and 25) and the second "dual monaural" embodiment (FIG. 26) and note that this third embodiment effectively combines the processing described for the first two embodiments, albeit with the "piecewise construction" approach described in the original specification.

As described in ¶0051 herein and in the original specification, τ sample shifts can be used to steer the "look" direction of the microphone array. Here we assume that the target talker is "straight ahead" at 0°; i.e., directly in front of the ALD user. Hence, the "Left, Right" processing for the binaural microphone pair ([L,R]) does not need to be steered via τ sample shifts and $\beta_{L,R}$ is given the default unity value (i.e., $\beta_{L,R}=1$). However, the "look" directions of the [L, L2] and [R, R2] microphone pairs will be steered 90°; i.e., towards the target talker.

As shown on the far Left side of FIGS. 29 and 30, τ sample shifts delay the signals from the anterior L and R microphones (See FIG. 27), relative to the posterior L2 and R2 microphones, before Time-Frequency analysis, so as to steer the "look" direction by 90°, towards a target talker in front of the ALD user. The τ sample shifts are computed for a given microphone spacing where $F_s$ is the sampling rate, $d_L$ and $d_R$ are the inter-microphone spacing in meters for the Left ([L, L2]) and Right ([R, R2]) side microphone pairs, λ is the speed of sound in meters per second and θ is the specified angular "look" direction in radians:

$$\tau_L = \left\lfloor f_s \times \frac{d_L}{\lambda}\sin(\theta)\right\rceil \quad \tau_R = \left\lfloor f_s \times \frac{d_R}{\lambda}\sin(\theta)\right\rceil \tag{59}$$

Values of $$\theta = \frac{\pi}{2}$$

and d=10 mm (i.e., $d_L$=10 and $d_R$=10 mm) are used for the processing and array configuration illustrated in FIGS. 26 and 27. Because the "look" direction is steered 90° (i.e., $$\theta = \frac{\pi}{2}$$

radians), a value of β=2 is used for the scaling parameters $\beta_L$ and $\beta_R$ (i.e., $\beta_L$=2 and $\beta_R$=2) used to compute $\Gamma_L$ [k] and $\Gamma_R$[k] for the Left ([L,L2]) and Right ([R,R2]) microphone pairs, respectively. As illustrated on the left hand side of FIGS. 29 and 30, the τ sample shifts are used to delay $x_L$[m] and $x_R$[m]; although the same $X_L$[n, k] and $X_R$[n, k] notation is used for all three Ratio Mask (RM) computations, $X_L$[n, k] and $X_R$[n, k] are in this case local variables, computed uniquely for each of the three RM computations.

The "piecewise construction" STTC processing for this third embodiment is illustrated in FIGS. 27-30. Each of the three microphone pairs ([L,R], [L,L2], [R,R2]) yields a Ratio Mask ($RM_{L,R}$, $RM_L$ and $RM_R$). Here the chimeric Global Ratio Mask $RM_G$ has the 0 to 2 kHz and 3 to 4 kHz frequency channels from $RM_{L,R}$ and the 2 to 3 kHz and 4 kHz to F/2 frequency channels from $RM_L$ and $RM_R$ (see FIG. 28).

Pairwise ratio masks RM are calculated as follows; i.e., there is a unique RM for each pair of microphones ([L,R], [L,L2], [R,R2]):

$$RM_{L,R}[n,k] = \frac{|X_L[n,k]| + |X_R[n,k]| - \Gamma_{[L,R]}[k]|X_L[n,k] - X_R[n,k]|}{|X_L[n,k]| + |X_R[n,k]|} \tag{60a}$$

$$RM_L[n,k] = \frac{|X_L[n,k]| + |X_{L2}[n,k]| - \Gamma_L[k]|X_L[n,k] - X_{L2}[n,k]|}{|X_L[n,k]| + |X_{L2}[n,k]|} \tag{60b}$$

$$RM_R[n,k] = \frac{|X_R[n,k]| + |X_{R2}[n,k]| - \Gamma_R[k]|X_R[n,k] - X_{R2}[n,k]|}{|X_R[n,k]| + |X_{R2}[n,k]|} \tag{60c}$$

A pairwise Phase Difference Normalization Vector (PDNV) Γ[k], which scales the respective pairwise Noise ($\hat{N}$) estimate, can be pre-computed for each microphone pair spacing:

$$\Gamma_{[L,R]}[k] = \begin{cases} \dfrac{1}{\mathcal{P}_{[L,R]}[k]} = \left(\left|{}_{\angle}e^{j2\pi\omega_k\beta\frac{d_{L,R}}{\lambda}\sin(\theta_{max})}\right|\right)^{-1}, & \text{if } \omega_k \le F_{c_{L,R}}\text{Hz} \\ 1, & \text{if } \omega_k > F_{c_{L,R}}\text{Hz} \end{cases} \tag{61a}$$

$$\Gamma_L[k] = \begin{cases} \dfrac{1}{\mathcal{P}_L[k]} = \left(\left|{}_{\angle}e^{j2\pi\omega_k\beta_L\frac{d_L}{\lambda}\sin(\theta_{max})}\right|\right)^{-1}, & \text{if } \omega_k \le F_{c_L}\text{Hz} \\ 1, & \text{if } \omega_k > F_{c_L}\text{Hz} \end{cases} \tag{61b}$$

$$\Gamma_R[k] = \begin{cases} \dfrac{1}{\mathcal{P}_R[k]} = \left(\left|{}_{\angle}e^{j2\pi\omega_k\beta_R\frac{d_R}{\lambda}\sin(\theta_{max})}\right|\right)^{-1}, & \text{if } \omega_k \le F_{c_R}\text{Hz} \\ 1, & \text{if } \omega_k > F_{c_R}\text{Hz} \end{cases} \tag{61c}$$

Below the pre-determined frequency cutoffs $F_{c_{L,R}}$, $F_{c_L}$ and $F_{c_R}$, the pairwise PDNV Γ[k] is inversely proportional to the discrete-frequency wrapped absolute phase difference $\mathcal{P}$ (see equation 61) at a maximum possible angular separation of θ=π/2 radians. Although the pairwise PDNV Γ[k] can be equivalent to the inverse of $\mathcal{P}$ across all discrete frequencies $w_k$, here Γ[k] is set to unity at and above a pre-determined frequency cutoff. This alternative processing, for a binaural hearing aid, is illustrated in the block diagrams in FIGS. 29 and 30.

The block diagrams in FIGS. 29 and 30 illustrate two variations on the processing. In FIG. 29, the "Piecewise Construction" is effected independently for the Left and Right ears, with frequency channels for the Left side $RM_G$ chosen from $RM_L$ and frequency channels for the Right side $RM_G$ chosen from $RM_R$. In FIG. 30, only one $RM_G$, or a post-processed variant thereof, is computed and applied to the signals at both ears, so as to preserve binaural cues for spatial hearing. The block diagram in FIG. 29 also illustrates an optional post processing "Channel Weighting" (i.e., smoothing along frequency) step, as described in ¶0080-0081.

Yet another variation on the processing described here could use the reconstruction stage described in ¶0081-0082, and illustrated on the right side of FIG. 14, wherein a user-defined "mix" parameter $\alpha$ would allow the user to determine the ratio of processed and unprocessed output. Further variations might allow the user, or an audiologist, to determine the value of certain parameters, for example, the $d_{L,R}$ parameter specifying the distance in meters between the Left and Right in-ear microphones, the $\beta$ value used to compute the PDNV, or whether to use frequency channels from the widely spaced [L, R] microphones, or from the narrowly spaced ([L, L2] and [R, R2]) microphones, for the 3-4 kHz frequency range (see FIG. 28).

STTC Processing can be Used as a Post-Filter for Fixed and/or Adaptive Beamforming.

Alternative processing could also involve using the Global Ratio Mask $RM_G$, or a post-processed variant thereof, as a postfilter for a fixed and/or adaptive beamformer. The beamforming could be implemented using the same array of microphones, or a subset thereof, used for the STTC processing. This was described in ¶0049-0052 and FIG. 12 of the original specification for a simple fixed beamformer, where the T-F mask computed by STTC processing was used as a post-filter for the average of the frequency domain signals from all microphones in the array. Fixed and adaptive beamforming techniques generally yield a mono output, hence there is a potential tradeoff here between enhancing speech intelligibility, and/or speech quality, at the expense of the loss of binaural cues for spatial hearing. The ideal mix of processed and unprocessed output, and of STTC processing and beamforming, could be defined by the user, either beforehand or online via a user interface, for example via a smartphone application.

As mentioned in ¶0013 herein and in the original specification, an advantage of the STTC processing described herein, relative to adaptive beamforming techniques, such as the MWF and MVDR beamformers, which generally have diotic (i.e., mono) outputs, is that the time-varying filter computed by the STTC processing is a set of frequency channel weights that can be applied independently to signals at the Left and Right ear, thereby enhancing speech intelligibility for a target talker while still preserving binaural cues for spatial hearing.

When using the STTC T-F mask as a post-filter for fixed and/or adaptive beamforming, any benefit measured in objective measures of performance (i.e., noise reduction, speech intelligibility, speech quality) may be offset by the loss of binaural cues for spatial hearing, which are important for maintaining a sense of spatial and situational awareness. The user of the assistive listening device, or machine hearing device, can determine for themselves, and for their current listening environment, the ideal combination of STTC processing, fixed and/or adaptive beamforming, and unprocessed output via a user-interface.

STTC Processing can be Used for Online Remote Communication Between Conversants.

As mentioned in ¶0009 herein and in the original specification, STTC processing can be implemented as a computer-integrated front-end for teleconferencing (i.e., remote communication); more generally, the STTC front-end approach may be used for Human-Computer Interaction (HCI) in environments with multiple competing talkers, such as air-traffic control towers, and variations could be integrated into use-environment structures such as the cockpit of an airplane. Hence the STTC processing, which can enhance speech intelligibility in real-time, could be used on both ends of an online remote communication between multiple human conversants, for example, between an air-traffic controller and an airplane pilot, both of whom might be in a noisy environment with multiple stationary and/or non-stationary interfering sound sources.

While various embodiments of the invention have been particularly shown and described, it will be understood by those skilled in the art that various changes in form and details may be made therein without departing from the spirit and scope of the invention as defined by the appended claims.

What is claimed:

1. An assistive listening device for use in the presence of stationary interfering sound sources and/or non-stationary interfering sound sources, comprising an array of microphones arranged into a set of microphone pairs positioned about an axis with respective distinct intra-pair microphone spacings, each microphone of the array of microphones generating a respective audio input signal;

a pair of ear-worn loudspeakers; and audio circuitry configured to compute a set of time-varying filters, for real-time speech intelligibility enhancement, using causal and memoryless frame-by-frame processing, comprising (1) applying a short-time frequency transform to each of the respective audio input signals, thereby converting the respective time domain signals into respective frequency-domain signals for every short-time analysis frame, (2) calculating a pairwise noise estimate by first subtracting the respective frequency-domain signals from a microphone pair and thereafter taking the magnitude of the difference, (3) calculating a pairwise mixture estimate by first taking the magnitudes of the respective frequency domain signals from a microphone pair, and thereafter adding the respective magnitudes, (4) scaling the pairwise noise estimate by a pre-computed pairwise Phase Difference Normalization Vector (PDNV), which normalizes the pairwise noise estimate, at each discrete frequency, in a manner dependent on the value of the maximum possible phase difference, at each discrete frequency, for a given microphone pair spacing, and (5) calculating a pairwise ratio mask from the pairwise noise estimate and the pairwise mixture estimate for each of the respective microphone pairs, wherein the calculation of the pairwise ratio mask includes the aforementioned frequency-domain subtraction of signals and scaling of the pairwise noise estimate by the pre-computed pairwise PDNV, (6) calculating a global ratio mask, which is an effective time-varying filter with a vector of frequency channel weights for every short-time analysis frame, from the set of pairwise ratio masks, with the frequency channels from each pairwise ratio mask chosen according to the frequency range(s) for which the distinct intra-pair microphone spacing provides a positive absolute phase difference; wherein when using only one pair of microphones, the singular pairwise ratio mask and the global ratio mask are equivalent, and (7) applying the global ratio mask, or a post-processed variant thereof, and inverse short-time frequency transforms, to selected ones of the frequency-domain signals, or to the frequency-domain output of a fixed or adaptive beamformer that operates in parallel using the same array of microphones (or a subset thereof), thereby suppressing both the stationary and the non-stationary interfering sound sources in real-time and generating an audio output signal for driving the loudspeakers.

2. The assistive listening device of claim 1, wherein the array of microphones includes a set of one or more pairs of microphones with predetermined intra-pair microphone spacings.

3. The assistive listening device of claim 1, wherein the array of microphones are arranged on a head-worn frame worn by a user.

4. The assistive listening device of claim 3, wherein the head-worn frame is an eyeglass frame.

5. The assistive listening device of claim 4, wherein the array of microphones are arranged across a front of the eyeglass frame.

6. The assistive listening device of claim 4, wherein the array of microphones includes microphones arranged on at least one of the temple pieces (i.e., stems) of the eyeglass frame.

7. The assistive listening device of claim 1, wherein the array of microphones includes in-ear or near-ear microphones whose corresponding frequency-domain signals are the selected frequency-domain signals to which the global ratio mask, or a post-processed variant thereof, and inverse short-time frequency transforms are applied.

8. The assistive listening device of claim 1, wherein the processed and unprocessed frequency-domain signals are combined before applying inverse short-time frequency transforms, and a user of the device determines the mixture of processed and unprocessed output, either beforehand or online via a user-interface.

9. A machine hearing device for generating speech signals to be used in identifying semantic content in the presence of stationary interfering sound sources and/or non-stationary interfering sound sources, and thereby allowing for remote communication and/or the performance of automated actions by related systems in response to the identified semantic content, the hearing device comprising:

a set of microphones generating respective audio input signals arranged in an array having a set of microphone pairs arranged about an axis with pre-determined intra-pair microphone spacings; and audio circuitry configured to compute a set of time-varying filters, for real-time speech intelligibility enhancement, using causal and memoryless frame-by-frame processing, comprising (1) applying a short-time frequency transform to each of the respective audio input signals, thereby converting the respective time domain signals into respective frequency-domain signals for every short-time analysis frame, (2) calculating a pairwise noise estimate by first subtracting the respective frequency-domain signals from a microphone pair and thereafter taking the magnitude of the difference, (3) calculating a pairwise mixture estimate by first taking the magnitudes of the respective frequency domain signals from a microphone pair, and thereafter adding the respective magnitudes, (4) scaling the pairwise noise estimate by a pre-computed pairwise Phase Difference Normalization Vector (PDNV), which normalizes the pairwise noise estimate, at each discrete frequency, in a manner dependent on the value of the maximum possible phase difference, at each discrete frequency, for a given microphone pair spacing, and (5) calculating a pairwise ratio mask from the pairwise noise estimate and the pairwise mixture estimate for each of the respective microphone pairs, wherein the calculation of the pairwise ratio mask includes the aforementioned frequency-domain subtraction of signals and scaling of the pairwise noise estimate by the pre-computed pairwise PDNV, (6) calculating a global ratio mask, which is an effective time-varying filter with a vector of frequency channel weights for every short-time analysis frame, from the set of pairwise ratio masks, with the frequency channels from each pairwise ratio mask chosen according to the frequency range(s) for which the distinct intra-pair microphone spacing provides a positive absolute phase difference; wherein when using only one pair of microphones, the singular pairwise ratio mask and the global ratio mask are equivalent, and (7) applying the global ratio mask, or a post-processed variant thereof, and inverse short-time frequency transforms, to selected ones of the frequency-domain signals, or to the frequency-domain output of a fixed or adaptive beamformer that operates in parallel using the same array of microphones (or a subset thereof), thereby suppressing both the stationary and the non-stationary interfering sound sources in real-time and allowing for identification of the target speech signal.

10. The machine hearing device of claim 9, wherein the array of microphones includes a set of one or more pairs of microphones with predetermined intra-pair microphone spacings.

11. The machine hearing device of claim 9, wherein the array of microphones are arranged along a border of a display that can be positioned in front of a user.

12. The machine listening device of claim 9, wherein the array of microphones is integrated into the housing of a digital device that responds to voice commands.

13. The assistive listening device of claim 9, wherein the array of microphones is integrated into the housing of a portable digital device.

14. The machine hearing device of claim 9, wherein the hardware configuration is adapted for remote communication in one or more noisy listening environments.

15. The machine hearing device of claim 9, wherein the hardware configuration is adapted for remote communication between two or more human conversants.

16. The machine hearing device of claim 9, wherein the array of microphones is integrated into a use-environment structure.

17. The machine hearing device of claim 16, wherein the use-environment structure is the cabin or cockpit of a vehicle.

18. An assistive listening device for use in the presence of stationary interfering sound sources and/or non-stationary interfering sound sources, comprising One or more pairs of in-ear or near-ear microphones, each microphone generating a respective audio input signal;

a pair of ear-worn loudspeakers; and audio circuitry configured to compute a time-varying filter, for real-time speech intelligibility enhancement, using causal and memoryless frame-by-frame processing, comprising (1) applying a short-time frequency transform to each of the respective audio input signals, thereby converting the respective time domain signals into respective frequency-domain signals for every short-time analysis frame, (2) calculating a pairwise noise estimate by first subtracting the respective frequency-domain signals from a microphone pair and thereafter taking the magnitude of the difference, (3) calculating a pairwise mixture estimate by first taking the magnitudes of the respective frequency-domain signals from a microphone pair, and thereafter adding the respective magnitudes, (4) scaling the pairwise noise estimate by a pre-computed pairwise Phase Difference Normalization Vector (PDNV), which normalizes the pairwise noise estimate, at each discrete frequency, in a manner dependent on the value of the maximum possible phase difference, at each discrete frequency, for a given microphone pair spacing, and (5) calculating a pairwise ratio mask from the pairwise noise estimate and the pairwise mixture estimate for each of the respective microphone pairs, wherein the calculation of the pairwise ratio mask includes the aforementioned frequency-domain subtraction of signals and scaling of the pairwise noise estimate by the pre-computed pairwise PDNV, (6) calculating a global ratio mask, which is an effective time-varying filter with a vector of frequency channel weights for every short-time analysis frame, from the set of pairwise ratio masks, with the frequency channels from each pairwise ratio mask chosen according to the frequency range(s) for which the distinct intra-pair microphone spacing provides a positive absolute phase difference; wherein when using only one pair of microphones, the singular pairwise ratio mask and the global ratio mask are equivalent, and (7) applying the global ratio mask, or a post-processed variant thereof, and inverse short-time frequency transforms, to the frequency-domain signals from the in-ear or near-ear microphones, or to the frequency-domain output of a fixed or adaptive beamformer that operates in parallel using the same array of microphones (or a subset thereof), thereby suppressing both the stationary and the non-stationary interfering sound sources in real-time and generating an audio output signal for driving the loudspeakers.

19. The assistive listening device of claim 18, wherein values of a set of processing parameters can be specified and/or tuned by an audiologist, and/or by the user of the device, either beforehand or online via a user interface.

20. The assistive listening device of claim 18, wherein the processed and unprocessed frequency-domain signals are combined before applying inverse short-time frequency transforms, and a user of the device determines the mixture of processed and unprocessed output, either beforehand or online via a user interface.

* * * * *